US011937668B2

(12) United States Patent
Wu

(10) Patent No.: US 11,937,668 B2
(45) Date of Patent: Mar. 26, 2024

(54) FASTENING DEVICE FOR REMOVABLY ATTACHING AN OBJECT, AS WELL AS A METHOD FOR REMOVABLY ATTACHING AN OBJECT

(71) Applicant: LUMEO TECHNOLOGY AB, Gothenburg (SE)

(72) Inventor: Leo Hong Wu, Gothenburg (SE)

(73) Assignee: LUMEO TECHNOLOGY AB, Gothenburg (SE)

( * ) Notice: Subject to any disclaimer, the term of this patent is extended or adjusted under 35 U.S.C. 154(b) by 189 days.

(21) Appl. No.: 17/441,470

(22) PCT Filed: Mar. 19, 2020

(86) PCT No.: PCT/SE2020/050291
§ 371 (c)(1),
(2) Date: Sep. 21, 2021

(87) PCT Pub. No.: WO2020/197470
PCT Pub. Date: Oct. 1, 2020

(65) Prior Publication Data

US 2022/0151346 A1 May 19, 2022

(30) Foreign Application Priority Data

Mar. 22, 2019 (SE) ..... 1950359-8

(51) Int. Cl.
*A44B 1/26* (2006.01)

(52) U.S. Cl.
CPC ..... *A44B 1/26* (2013.01)

(58) Field of Classification Search
CPC .... A44B 1/26; A44B 1/40; A44B 9/16; A47G 27/0418; B60N 3/046
See application file for complete search history.

(56) References Cited

U.S. PATENT DOCUMENTS 2,033,039 A * 3/1936 Limpert ..... F16B 5/0642 24/711.4
3,041,694 A * 7/1962 Hansen ..... D01D 4/022 24/103

(Continued)

FOREIGN PATENT DOCUMENTS

FR 1039193 A 10/1953
JP 63-230828 9/1988

(Continued)

OTHER PUBLICATIONS

International Search Report for PCT/SE2020/050291, dated May 20, 2020, 4 pages.

(Continued)

*Primary Examiner* — Robert Sandy
(74) *Attorney, Agent, or Firm* — MARSHALL, GERSTEIN & BORUN LLP

(57) ABSTRACT

Disclosed is a fastening device and a method of removably attaching an object to a surface of a material, the fastening device including a base, rotatable around an axis of rotation; a support frame mechanically supporting the base allowing the base to rotate with respect to the support frame, the axis of rotation of the base being transverse to a reference plane of the support frame; an open-ring shaped piercing member including secured and piercing ends, secured end attached to the base, and the piercing member configured so the piercing end follows a first curved trajectory when the base is rotated; and a first abutment, on the support frame and configured to cause the piercing end of the piercing member to follow a second curved trajectory; so the plane of the second trajectory is offset by a deviation angle from the plane of the first trajectory.

20 Claims, 11 Drawing Sheets

(56) References Cited

U.S. PATENT DOCUMENTS

| | | | | |
|---|---|---|---|---|
| 4,817,251 | A | 4/1989 | Shirley-Smtih et al. | |
| 5,095,589 | A | 3/1992 | Ritchie et al. | |
| 5,163,343 | A * | 11/1992 | Gish | F16B 25/0005 81/125 |
| 6,412,142 | B1 * | 7/2002 | Iverson | B60N 3/046 16/6 |
| 2003/0009441 | A1 | 1/2003 | Holsten et al. | |
| 2022/0160157 | A1 * | 5/2022 | Prasch | A47G 27/0418 |

FOREIGN PATENT DOCUMENTS

| | | |
|---|---|---|
| JP | 06-011515 | 2/1994 |
| JP | 11318516 | 11/1999 |
| JP | 2001130156 A | 5/2001 |
| JP | 3194318 | 11/2014 |

OTHER PUBLICATIONS

Written Opinion of the ISA for PCT/SE2020/050291, dated May 20, 2020, 4 pages.
European Search Report, European Application No. 20788503.1, dated Oct. 21, 2022.
Office Action in corresponding Japanese patent application No. 2021-559498, dated Aug. 18, 2023.

* cited by examiner

FASTENING DEVICE FOR REMOVABLY ATTACHING AN OBJECT, AS WELL AS A METHOD FOR REMOVABLY ATTACHING AN OBJECT

This application is the U.S. national phase of International Application No. PCT/SE2020/050291 filed 19 Mar. 2020, which designated the U.S. and claims priority to SE Patent Application No. 1950359-8 filed 22 Mar. 2019, the entire contents of each of which are hereby incorporated by reference.

TECHNICAL FIELD OF THE INVENTION

The present invention relates to a fastening device for removably attaching objects to a surface and an attachment method thereof.

BACKGROUND OF THE INVENTION

In order to fasten external objects to a surface such as the surface of a sheet of material, meshed fabric, grids and fibers of different material, various systems such as pins, buttons, clamps, badge holder clips, etc. have been devised. Usually, on the one hand, fastening small ornamental objects such as brooches or card plates, do not require frequent detachment from, or attachment to the target surface. Therefore, so long as the fastening approach does not permanently damage the material, it is not a concern if the detaching/reattaching process is convenient, quick and simple.

On the other hand, it is highly desirable to provide a versatile and reusable attachment/detachment system of objects to the target surfaces, while facilitating a simple and convenient user experience. One example of such frequent attachment/detachment systems are devices used to attach external objects such as personal accessories, mobile phones, personal wallets, keys, etc. to a surface of a material e.g. a part of a person's clothing while firmly gripping these objects in place in order to prevent theft or accidental loss. These anti-theft, anti-drop, or anti-loss devices shall thus endure a much stronger force compared to e.g. a simple clip card plate holder and at the same time provide a simple mechanism to allow the user to detach and access them when required. In one commercially available product, C-Safe™ PocketLock from the present applicant Lumeo Technology AB of Sweden, a clamping device enables easy attachment of above-mentioned everyday objects to the fabric or clothing of a user. A small magnet link is attached to the objects, and a clamp or lock set comprising two separable parts receives the fabric between the two parts when opened and fastens the fabric there between when closed in the clamped condition. Thus, attaching the small magnet link to another magnetic component incorporated in the clamp lock enables easy attachment and detachment of objects to the clothing.

This device solves the problem of avoiding theft or accidental drops effectively in comparison to other known solutions using e.g. costly or complicated electronics or sensor devices operating based on location-identification systems which rely on tracking e.g. a BLUETOOTH or GPS signal between a sender and a receiver. However, the above solution is advantageous as long as the clamped fabric is thin and flexible, does not get damaged easily by the action of clamping and that the user is not obliged to remove and reinstall the clamp lock frequently e.g. due to cleaning of the clothing or use of the device on multiple clothing items.

Therefore, there is a need to provide a more versatile, cost-effective and efficient solution for frequent and straightforward fastening/unfastening of objects to and from target surfaces.

SUMMARY OF THE INVENTION

It is accordingly an object of the present invention to improve the current state of the art and to mitigate at least some of the above mentioned shortcomings.

These and other objects are achieved by providing a fastening device for removably attaching an object to a surface of a material and a method of removably attaching an object to the surface as defined in the appended claims.

According to a first aspect of the present invention, there is provided a fastening device for removably attaching an object to a surface of a material, the fastening device comprising:

a base, rotatable in at least one direction around an axis of rotation;

a support frame arranged to mechanically support the base wherein the base is configured to rotate with respect to the support frame and the axis of rotation of the base is transverse to a reference plane of the support frame;

at least one open-ring shaped piercing member comprising a secured end attached to the base and a piercing end, the piercing member configured such that the piercing end of the piercing member follows a first curved trajectory when the base is rotated; and a first abutment, arranged on the support frame and configured to, when brought in contact with the piercing member, cause the piercing end of the piercing member to follow a second curved trajectory;

such that the plane of the second trajectory is offset by a deviation angle from the plane of the first trajectory.

The surface of the material may also be referred to as "the target surface" or "the surface" in the rest of this disclosure, but it shall be appreciated that it is not restricted to a specific surface or side of the material and the fastening device would similarly be attachable regardless of the position or orientation of the different surfaces and different sides of the material.

By "removably attaching" in the present context is intended that two objects or elements or components e.g. an external object and the target surface can be repeatedly attached to and detached from each other. However, it clearly does not exclude when the two objects are attached together and kept in the attached status permanently or for relatively long periods of time. Further, attaching and detaching the objects to the target surface may be performed manually e.g. by involvement of a user or it may be performed remotely or automatically e.g. by sending actuation commands to a motorized base which can rotate in a desired direction and fasten/unfasten the device to and/or from the intended target surface without any user involvement.

The invention is at least partly based on the realization that by providing a curved or ring-shaped piecing member such as a needle attached to a rotatable base such as a rotatable disc-shaped base and by rotating the base around its axis of rotation a controlled curved trajectory can be achieved for the piercing member. In other words, the rotational force rotating the base can be exerted on the piercing member and stably and effectively drive the piercing member to engage with the target surface of the material that is intended to be penetrated. By this desirable principle and system according to the invention and by further taking advantage of the first abutment arranged e.g. on the support frame of the fastening device the trajectory of the piercing end of the piercing member (the tip of the needle) can be customizably controlled. By deviating the tip of the needle from the its first curved trajectory to a second curved trajectory the corresponding depth or angle of penetration of the needle in the target surface can be controlled. Accordingly, a safe, stable, and efficient means with surprising and advantageous effects for repeatedly attaching and/or detaching external objects such as name plates, badges, mobile phones, motion sensors, light sensors and audio sensors etc. to the target surface of a material such as a meshed surface of a sheet of fabric or clothing can be achieved. The external objects can be attached to either side of the fastening device, e.g. by using a magnetic link or other attachment mechanisms, other than the side fastened to the target surface.

The base may be a component made of different materials for example, hard plastic, metal, compressed cardboard, dense Styrofoam, wood, etc. Further, different shapes and geometries are conceivable for the base for example, a disc-shaped base, cone-shaped base, cylindrical base, etc. The base may for example be a flat circular disc or a disc with convex or concave surface profiles on one or multiple sides or a combination of flat, concave and/or convex surface profiles.

For example, the base may have a 3D shape of a cone, a disc or a cylinder and a 2D cross-section of a circular top and/or bottom surface.

The support frame in the context of the present invention is to be understood as a physical structure capable of mechanically supporting the rotatable base.

The axis of rotation of the base may be transverse to a plane of the support frame which may be referred to as "reference plane" in this description. For instance, if the reference plane is a horizontal plane, the axis of rotation of the base may be partly transverse or partly perpendicular to the horizontal plane e.g. the axis of rotation may extend in the vertical direction. In various embodiments the reference plane of the support frame may have different orientations and thus the base could accordingly be oriented such that the axis of rotation still be transverse to the plane of the support frame.

The open-ring shaped piercing member may have an open portion or a cut portion i.e. a part or portion of the ring may be absent or be removed and thus the ring is not completely closed. Stated differently, the open portion may be a gap between the secured end and the piercing end of the piercing member. The open portion e.g. in case of a substantially circular ring may be an arc of the ring with a corresponding central angle in the range of 1 to 180 degrees, e.g. 10 to 90 degrees, or e.g. 5 to 10 degrees or e.g. 1 to 5 degrees. In case of an elliptical ring the open portion may similarly correspond to a certain arc length of the ellipse. Alternatively or additionally, the piercing end and the secured end of the piercing member may overlap i.e. the ring is still open but one end may have a higher vertical elevation than the other end and may partly extend over the other end.

By first curved trajectory in the context of the present invention it is intended that when the base undergoes an in-plane rotation e.g. in a uniform (with constant angular rate of rotation) or non-uniform (with a changing rate of rotation) circular motion around a fixed axis of rotation, the piercing end of the piercing member follows a curved path which is also located in the same plane of motion as the base. The curved trajectory may alternatively be located in a parallel plane to the plane of motion of the base. This circular or rotational motion of the piercing end on the first curved trajectory may continue until it may be disrupted by an abutment.

By second curved trajectory it is meant a trajectory which may be substantially out of the initial plane of motion of the piercing end of the piercing member. In other words, the abutment may exert a force and guide the piercing end upon contact to deviate from its plane of motion (its first trajectory) to a second plane of motion (its second trajectory) which may be offset from the first or initial plane of motion by a certain angle i.e. angle of deviation or deviation angle.

According to the invention, the rotation of the base around its axis of rotation may be continuous or stepwise with the base arriving at a series of quasi-stationary positions during its rotational motion. By quasi-stationary positions it is meant the rotated positions of the base or intermediate rotated positions of the base including and in between the initial and final rotated positions of the base.

Additionally, quasi-stationary positions may correspond to different positions of the piercing member or the piercing end of the piercing member. In other words, each quasi stationary or rotated position of the base may also correspond to the quasi-stationary position of the piercing member or the piercing end. For instance, when the piercing end penetrates the target surface at a piercing point, the quasi-stationary position of the piercing end at this point may correspond to a certain rotated position of the base.

There's a large variety of application areas for the fastening device of the present invention including examples of attaching commodities and various accessories, sensors for measuring motion, light and/or audio such as activity trackers, audio recorder etc. to textile furniture, curtains, bed clothing, clothes and bags. Attachment of a lock to clothes in order to secure a valuable to the clothing item for anti-drop and anti-theft purpose. As body mount for action and wearable cameras, to attach the camera holder to textiles. Integrated to name tags as a replacement for simple needle pins, to make attachment and detachment of the tag more user-friendly. Applicable to industrial robots as a mean to manipulate textiles. Attachment of wearable audio recording devices on film and studio sets, or on the field interviews. Integrated into holders for glasses to attach the item to clothes. Integration alarms for clothes in retail stores as a new way to secure the fashion items in stores for anti-theft. Integrated with GPS devices to enable attachment of GPS devices to fabrics. Integrated in guns and tools holsters for secure attachment of the gun and tool on more locations in clothes and bags. Applied in surgical instruments, for example, in a tissue stitching device for stitching and closing of wounds. It can also be used in a sewing device for fabrics that enable sewing capabilities without needing access to both sides of the fabric. Such as, integration with a portable sewing device or integration with industrial sewing machines to name a few In accordance with one embodiment of the present invention, when the base may be rotated from an initial position to a first piercing position, the piercing end of the piercing member may be caused to pierce and engage with the surface at a first piercing point;

and wherein when the base may be rotated to a final rotated position the piercing member may be configured to reach a releasably locked position at the end of the second trajectory.

By "piercing position" of the base it is intended a rotated position of the base wherein in that position the piercing member engages and pierces the target surface in at least one piercing point. By "releasably locked position" in the present disclosure it is meant the end rotated position of the base when the curved piercing member creates a curved loop shape and arrives at its final quasi-stationary position. In some embodiments the piercing end may undergo further changes of trajectory upon further rotation of the base, e.g. a third or a forth or a fifth, curved trajectory, etc. before arriving at the releasably locked position. The piercing end may arrive at the releasably locked position at the end of the second trajectory or any other trajectories than the second trajectory such as the third or fourth or fifth trajectory. In the releasably locked position, the piercing end may be kept under a locked state until the user or an actuator triggers a retraction process resulting the piercing end to be released from the locked position and the piercing member being retracted to e.g. the initial quasi-stationary position. It should however be understood that other intermediate releasably locked positions may be contemplated for the piercing member, e.g. if it may be advantageous to stop the rotation of the base midway, before or after the piercing end penetrating the target surface.

Further in yet another embodiment of the present invention the fastening device may further comprise:

a second abutment, arranged on the support frame and when in contact with the piercing member configured for keeping the piercing member under a mechanical stress such that a portion of the piercing member which may be in contact with the second abutment may be prevented from a translational movement in the vertical direction with respect to the reference plane of the support frame.

The second abutment may be arranged to provide mechanical stability for the piercing member and to ensure a uniform movement of the piercing member during the rotation of the base and change of rotational trajectory imposed by the first abutment. The present inventor has realized that by providing a second abutment in the path of the piercing member a substantial control over the movement of the piercing member can be achieved. The piercing end of the piercing member, after changing its trajectory by the first abutment may continue its trajectory until it reaches a quasi-stationary positon where a portion of the piercing member comes in contact with the second abutment. The amount of mechanical stress applied to the piercing member may be kept constant during the operation of the device or may change at different quasi-stationary positions of the piercing member or rotated positions of the base. The piercing member may experience an engaged state i.e. mechanical stress or relaxed state i.e. no mechanical stress at the end of the second trajectory of the free end of the piercing member e.g. when arrived at the releasably locked position.

The first abutment may exert an upward vertical/transverse component of force on the piercing member, and the second abutment may exert a mechanical force in the opposite direction to the force component exerted by the first abutment e.g. a downward vertical/transverse component of force. Thus, the two opposite vertical/transverse force components applied to the piercing member can keep the piercing member positioned between the first and second abutments under a certain amount of mechanical stress.

It should be noted that the piercing member may arrive in contact with the first abutment prior to becoming in contact with the second abutment, even though the second abutment may be spatially positioned before the first abutment along the path of rotation of the piercing member. Simply explained, by the first abutment is to be understood the abutment which first comes in contact with the piercing member and by second abutment is to be understood the abutment which comes in contact with the piercing member after the first abutment.

In accordance with yet another exemplary embodiment of the present invention, the fastening device may further comprise:

a housing comprising the support frame, and the abutment(s), and encasing the base and the piercing member, the housing having a coupling side arranged to interface with the surface, the coupling side comprising a first opening disposed thereon such that when the base may be rotated from the initial position to a first rotated position, the free piercing end of the piercing member may be caused to protrude out of the first opening, and when the base may be rotated from the first rotated position to a second rotated position the free piercing end of the piercing member may be caused to reach a height peak with reference to the reference plane of the support frame and when the base may be further rotated from the second rotated position to a third rotated position, the free piercing end of the piercing member may be enabled to enter into a second opening arranged on the coupling side and disposed at a distance from the first opening, wherein the piercing member may be configured to reach the releasably locked position when the free piercing end of the piercing member may be inserted into the second opening.

The present inventor has realized that by arranging the base and the piercing member encased in a housing further advantages may be achieved. The housing may provide a protective envelope for the working components of the fastening device such as the base, piercing members, etc. and also can provide the fastening device with an advantage of effortless mountability on various target surfaces and materials. The housing may be positioned steadily on the target surface or be pushed firmly against the target surface e.g. in case of a flexible surface of a sheet of fabric or clothing. This ability provides the user with comfort and support in handling and operating the device. Accordingly, the rotation of the base, arranging the abutments on the support frame, connection of the base to its operation means such as a power transmission device, an actuator, etc. may as well be realized in a simpler and more straightforward manner.

The rotated positions of the base and accordingly the quasi-stationary positions of the piercing end are not in any way limited to the first, second, or third positions explained above. Accordingly, there might be as many intermediate rotated positions or quasi-stationary states in between each of the above-discussed first, second and third stated. For instance, the first piercing position and/or a second piercing position may correspond to each of the first and second rotated positions or alternatively correspond to further intermediate quasi-stationary positions of the piercing end in between the first and second rotated positions of the base.

In this embodiment the housing may be arranged such that the support frame may be an integrated part of the housing or be encompassed by the housing. The abutments may be arranged on the support frame or may be produced in one whole piece with the rest of the housing. For instance, the abutments may be a part of the body of the housing, extrusions from the body of the housing, tapering inner surfaces of the housing, etc. arranged to provide the functionality of changing the curved trajectory of the piercing member and provide mechanical support during the operation of the fastening device. The housing may also be arranged to increase the safety of the user by receiving the sharp piercing end of the piercing member in an opening and keep it in a releasably locked position until the piercing member is retracted by a release mechanism e.g. triggered by the user or automatically.

Additionally, the housing provides the fastening device with the possibility to be connected to other external apparatus, or technical machinery and equipment such as robotic arms.

In accordance with a further embodiment of the present invention the deviation angle may be determined by a vertical extension of the first abutment in relation to the reference plane of the support frame.

In accordance with yet another embodiment of the present invention the deviation angle may be determined by a distance between the first and the second abutments.

The inventors have realized that by adjusting the vertical elevation of the first abutment in relation to the reference plane the angle of deviation of the piercing end can be effectively controlled.

Further, by providing two abutments it is possible to adjust the height and/or distance between the abutments such that the angle of deviation between the first and second curved trajectories can be determined. For instance, the first abutment can be arranged at a higher vertical elevation than or at a closer/farther distance to the second abutment. The surprising effect and advantage of this embodiment is that by simply adjusting the height and/or distance i.e. space between the first and second abutments various penetration depths and angles can be customized for the piercing member without changing the amount of exerted force or rotational speed of the rotatable base.

In accordance with yet another embodiment of the present invention when the base may be further rotated from the first piercing position to a second piercing position, the piercing end of the piercing member may be further caused to pierce and engage with the surface at a second piercing point before it may reach the releasably locked position.

By providing a second piercing point for the piercing end it can be ensured that a secured and stable connection to the target surface is established before the piercing end settles i.e. arrives in the releasably locked position. Additionally or alternatively, to further increase the strength of the connection of the fastening device to the target surface, multiple piercing members can be arranged on the same base to penetrate the surface at multiple piercing points. Alternatively, each piercing member may be provided with customized piercing ends e.g. with fork-like ends with multiple tines, prongs, hooks, etc. to puncture the surface at several spots at each piercing point.

In accordance with yet another embodiment of the present invention when the base may be rotated from the first piercing position to the initial position the piercing end of the piercing member may be retracted and disengaged from the first piercing point on the surface.

By triggering a release mechanism e.g. by the user the fastening device can be detached from the target surface by retracting the piercing member from the piercing points on the target surface. The piercing member may be fully retracted e.g. by rotating the base in the opposite direction of the fastening direction. Thus the piercing member can be retracted completely from the releasably locked position to the initial position e.g. into the housing.

The piercing member may also be partially retracted between several quasi-stationary positions e.g. from the second piercing position to the first piercing position wherein the piercing end is retracted and disengaged from the second piercing point. By retracted it is meant that the piercing end follows a reverse trajectory e.g. reversed second or first trajectory by rotating the base in the reverse direction compared to its initial rotational direction i.e. when the piercing member is caused to pierce the target surface.

In accordance with yet another embodiment of the present invention the fastening device may further comprise:

- a power transmission device in mechanical connection with the base and connectable to an actuator device, the power transmission device configured to rotate the base by transmitting power from the actuator device to the base.

In order to operate the fastening device, the present inventor has realized that various driving mechanisms can be applied to drive the rotatable base. The power transmission device may be employed to transfer a driving power to the base and rotate the base accordingly. By mechanical connection generally it is meant that the transmission device would transfer mechanical power to the base resulting in a rotational motion of the base. In some embodiments, the power transmission device may be a separate component (intermediate component) and in some embodiments it may be integrated/manufactured with the rotatable base in one piece i.e. a part or portion of the base may be provided with means such as projections, teeth, cogs, or the like and can be used to transfer the rotational motion from the actuator to the rotating base.

The power transmission device may comprise at least one of a rotating plate, a drive gear, a cogged rack, a belt drive, a chain drive, and a wire and cam.

In accordance with yet another embodiment of the present invention the actuator device may comprise at least one of a lever, a tension spring, an electric servo motor, a stepper motor, a drill machine, and a petrol engine.

The power transmission device is generally mechanically and operationally connectable to a power source i.e. a mechanical, electrical, or similar appropriate power source to provide the rotational power for the movement of the base. The power transmission device may be connected to a manual power source or actuator device actuated by the user. In some embodiments the actuator device may be a bar or lever or a tension spring actuated or triggered by the user manually e.g. by a pull, push, press or drag action which transmits the mechanical power applied by the user via the transmission device to the base and can rotate the base in the desired direction. In other embodiments the actuator device may be a motor or engine. For instance, the actuator device may be a stepper motor or a servo motor automatically controllable and triggered by means of controller electronics. The controller electronics may be implemented in the fastening device and e.g. be activated by the press of a switch by the user. The controller electronics activating the actuator device may comprise network connection interfaces to enable the actuator device to be controlled remotely, e.g. via a web application, a smartphone application, or any other form of network based trigger signal which can actuate the actuator device and accordingly rotate the base. One advantage of this arrangement is that it enables the fastening device to be used in settings when direct user involvement in attaching the fastening device to the target surface may not be possible or not necessarily required. For example, in an industrial setting for handling clothing where a robotic arm is installed to transfer clothing from one line of production to another line e.g. packaging, the arm may be provided with multiple of fastening devices connected to the actuator device which can be controlled automatically by an operation software of the robotic arm or remotely by a user monitoring the operation of the robotic arm. In other embodiments drill machines, hybrid stepper motors, brushless DC motors, miniature petrol engines may be configured to rotate the base and accordingly fasten and unfasten the fastening device at desired speeds and revolutions.

According to a second aspect of the present invention there is provided a method of removably attaching an object to a surface of a material, the method comprising:

providing a base, rotatable in at least one direction around an axis of rotation;

providing a support frame to mechanically support the rotatable base wherein the axis of rotation of the base is transverse to a reference plane of the support frame;

providing at least one open-ring shaped piercing member comprising a secured end and a piercing end, the secured end attached to the base and, the piercing member configured such that the piercing end of the piercing member follows a first curved trajectory when the base is rotated; and providing a first abutment, arranged on the support frame and configured to, when brought in contact with the piercing member, causing the piercing end of the piercing member to follow a second curved trajectory;

such that the plane of the second trajectory is offset by a deviation angle from the plane of the first trajectory.

In accordance with yet another embodiment of the present invention the method may further comprise when the base may be rotated from an initial position to a first rotated position, causing the piercing end of the piercing member to pierce and engage with the surface at a first piercing point; and wherein when the base may be rotated to a final rotated position causing the piercing member to reach a releasably locked position at the end of the second trajectory.

With this aspect of the invention preferred features and advantages of the invention are readily available as in the previously discussed aspects of the invention, and vice versa.

These and other features of the present invention will in the following detailed description be further clarified with reference to the embodiments described hereinafter.

In addition to the main inventive concept disclosed above, the present disclosure also includes at least a second inventive concept, which may be used together with the main inventive concept or as separate technical solutions in the fastening device with a non-flexible piercing member. A second inventive concept disclosed herein relates to the use of a rigid piercing member which may be suitable to use when it is not desirable to have a flexible/resilient piercing member undergoing a considerable reversible deformation upon application of mechanical stress. Thus, a sturdy, mechanically rigid piercing member is preferred for such intended applications. According to the second inventive concept the rotatable base and the piercing member may be arranged with an inclination angle with respect to the reference plane of the supporting frame. Therefore, the axis of rotation of the base is also respectively inclined. According to the second inventive concept, the abutments may no longer be necessary to provide a change in the trajectory of the piercing end of the piercing member. Instead, due to the inclination of the piercing member and base in relation to the reference plane, the plane of the trajectory of the piercing member is by default offset by a deviation angle relative to the plane of the supporting frame. Therefore, the piercing member is enabled to rotate reciprocally with the rotatable base around the same axis of rotation without experiencing a change of trajectory imposed by an external abutment. The size of the rotating base may also be altered to fit the inclined configuration e.g. the size of the rotatable base with a rigid needle may be smaller than the size of a rotatable base with a flexible needle.

The further inventive concept may be made the subject of one or more divisional applications. Statements regarding materials, field of use, design, assembly, etc. made in relation to the first inventive concept described above apply in relevant parts to the further (second) inventive concept as well.

BRIEF DESCRIPTION OF THE DRAWINGS

The above objects, as well as additional objects, features and advantages of the present invention, will be more fully appreciated by reference to the following illustrative and non-limiting detailed description of embodiments of the present invention, when taken in conjunction with the accompanying drawings, wherein.

Figure 1C:
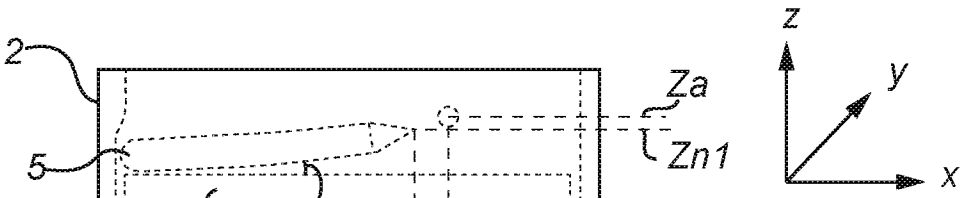
FIGS. 1*c*-1*f* show schematic side views of the fastening device of FIG. 1*a* in accordance with some embodiments of the present invention.

As illustrated in the figures, some features (including the piercing member, abutments, etc.) are or may be exaggerated for illustrative purposes and, thus, are provided to illustrate the general structures of embodiments of the present invention. Like reference numerals refer to like elements throughout.

DETAILED DESCRIPTION OF THE EMBODIMENTS

In the present detailed description, embodiments of the present invention will be discussed with the accompanying figures. It should be noted that this by no means limits the scope of the invention, which is also applicable in other circumstances for instance with other types or variants of the rotatable base and rotation mechanisms of the rotatable base or variants of the fastening device with various types of piercing members than the embodiments shown in the appended drawings.

The following description will use terms such as "top", "bottom", "inner", "outer", "side", "edge", "circumference", etc. These terms generally refer to the views and orientations as shown in the drawings. The terms are used for the reader's convenience only and shall not be limiting.

In the context of the present invention the directions and orientations such as vertical, longitudinal, and lateral directions need to be interpreted broadly and generally refer to the geometrical extensions of objects in a coordinate system such as a three-dimensional Cartesian coordinate system or a cylindrical or spherical coordinate system. The spatial extensions and positions of objects e.g. quasi-stationary positions of the base or piercing end of the piercing member can therefore be defined in at least one plane of the coordinate system e.g. by using x, y, z coordinates. Additionally or alternatively, spatial extensions and positions of the piercing end of the piercing member or the base may be defined by a radial distance (r) from the origin of the coordinate system and polar and azimuthal angles of a spherical coordinate system.

In essence, the vertical direction or the z-direction is orthogonal or perpendicular to the reference plane of the support frame. The longitudinal direction or the y-direction may be partly parallel to an imaginary line extending from the circumference of the rotatable base toward the center of the rotatable base. The y-direction however, may also be transverse to the imaginary line extending from the circumference to the center of the rotatable base. In an example of a circular base the imaginary line may extend radially from the circumference of the base towards the center. The imaginary line may be a radius of e.g. a circular base, or a diagonal or side of e.g. a square or rectangular rotatable base. The lateral direction or the x-direction is orthogonal to both the y-direction and the z-direction. The x-direction may be partly transverse to the radial imaginary line extending from the circumference to the center of the rotatable base but it may also be a direction parallel to the imaginary line.

Figure 1D:
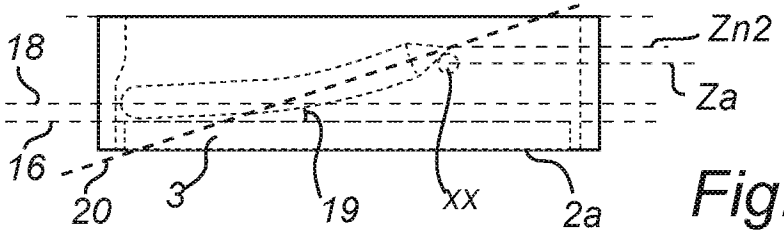
Figure 1E:
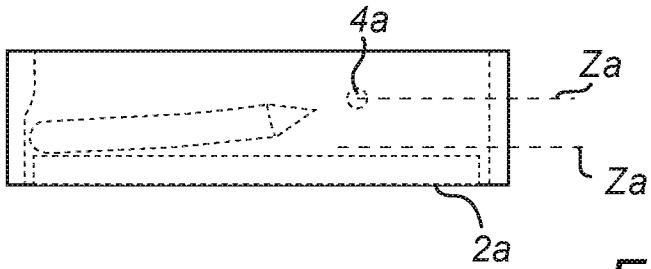
Figure 1F:
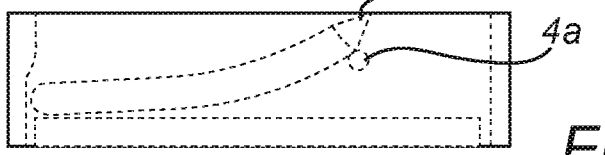
Figure 1A:
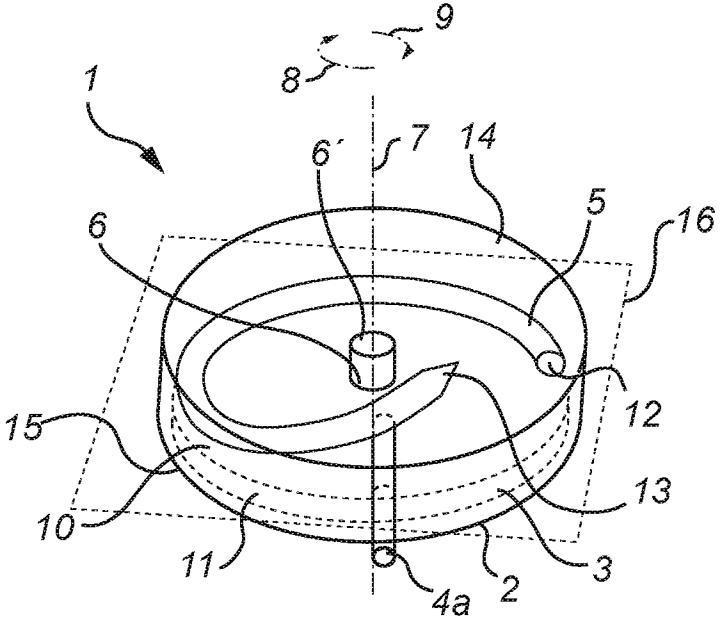
FIGS. 1*a*-1*b* show schematic perspective views of a fastening device in accordance with at least one embodiment of the present invention.

FIG. 1*a* illustrates the perspective view of the fastening device 1 in accordance with one embodiment wherein the fastening device comprises a support frame 2, a rotatable base 3, at least one first abutment 4*a*, and at least one piercing member 5. The support frame 2 in this embodiment may be a frame i.e. a rigid or semi-rigid structure made of e.g. plastic, metal, wood, etc. with various known technologies in the art such as injection molding, 3D printing, etc. The support frame provides a structure to mechanically support and carry/bear the rotatable base e.g. at only one side of the rotatable base e.g. a bottom side 15 or a top side 14 of the rotatable base. The support frame 2 may alternatively or additionally provide support on more than one side of the rotatable base 3 e.g. on two or three or four or all sides of the rotatable base 3. Additionally or alternatively, the support frame may entirely surround the rotatable base 3 i.e. enclose the rotatable base 3 completely e.g. as a housing, casing or similar.

In this embodiment, the base 3 is a circular or disc-shaped base which may be connected to a central axel 6' at its central part 6 via a connector element such as a pin, rod, stud or the like which allows the base to stably rotate around the devised element. The connector element may be an insertable external component or an extrusion which is a part of the base. In other words, the base may have a female opening (receptacle) to receive male connector elements. Wherein male and female elements have complimentary cross sectional shapes. Additionally or alternatively, the base 3 may have male extrusions to be inserted into female fittings e.g. on the support frame 2 or optionally into a receptacle portion of a housing or casing when present. The fitting of male and female elements may include threaded or cogged portions to engage or to be screwed and fastened together or may fit with a snap action or the like. The base 3 may also be arranged and enabled to rotate without the need for an external element e.g. by being supported and suspended by the support frame 2 or a housing on at least two, three or all sides which allows for the base to be rotated freely. Additionally or alternatively, the base 3 may be encompassed by the support frame 2 or by a portion of the support frame 2 or optionally by a portion of a housing and thus enabled to rotate freely. The base 3 can be rotated around an axis of rotation 7 of the base, wherein the axis of rotation 7 may not change its orientation and thus the base may not experience any wobbling, precession or translational out-of-plane motion during its rotational motion. The base is enabled to rotate in clockwise 8 and/or counter clockwise 9 directions. In this embodiment, the first abutment 4*a* extends in the y-direction i.e. radially from the periphery or circumference 10 of the support frame 2 or optionally the periphery or circumference 11 of the base 3 toward the central part 6 of the base. Stated differently, the abutment 4*a* is arranged at a distal portion 10 of the support frame 2 and may extend toward the center of the base 6. Even though in this embodiment the abutment has its longest extension substantially in the y-direction, the inventors have also found that the abutment(s) 4*a* may be arranged at the periphery of the support frame 2 and have its longest extension in the x-direction i.e. the lateral extension of the abutment(s) 4*a* can be larger than the longitudinal extension of the abutment(s) 4*a*. The longitudinal extension of the abutment(s) 4*a* may be in the range of e.g. 1 to 10 times the lateral extension of the abutment(s) 4*a*. Alternatively, the lateral extension of the abutment(s) 4*a* may be in the range of e.g. 1 to 10 times the longitudinal extension of the abutment(s) 4*a*. The abutment 4*a* may also extend in any other orientation e.g. with various azimuthal angles in the x-y plane than the orientation shown in this embodiment. The abutment 4*a* in this embodiment is in form of a cylindrical rod with a circular (as shown in FIGS. 1*c*-1*i*) cross section. It should however be appreciated that the abutment 4*a* may have any suitable shape and geometrical extension suited to the design aspects of the fastening device e.g. it may be a cone shaped rod, or a square pillar with circular, oval or rectangular cross-sections. The piercing member 5 in this embodiment can be a resilient, flexible or semi-flexible needle capable of undergoing controlled deformations and regaining its original shape after deformations such as bending, twisting, curling, etc. The flexible piercing member 5 may have various amounts of tolerance for mechanical stress, tension and strain and accordingly undergo different degrees of reversible deformation when placed under mechanical stress. The piercing member be made of resilient wire or strip material. The piercing member 5 has a secured end 12 preferably attached to the rotatable base 3.

The piercing member 5 may be attached to the base 3 at any desired part, portion or side of the base 3. The piercing member 5 may be attached to the base 3 permanently by molding/embedding in the base 3 or manufactured in a single whole piece together with the base 3. The piercing member 5 may also be attachable or removably attached to the base 3. By attachable or removably attached here it is to be understood that the secured end 12 of the piercing member 5 may be repeatedly attached to and detached from the base 3 e.g. by means of a snap-fit function. The piercing member 5 may also be screwed to the base 3 or be connected to the base 3 in any repeatedly detachable manner. Having the piercing member 5 as a separate component allows for facilitated customization of the fastening device e.g. the same base may be customized to be used with different kinds of needles with varying size, shape, length, curve, tension or mechanical stress durability, etc. This way also reparation or replacement of a damaged or broken needle becomes much easier, an action which may even be performed by the user itself and further reduce the costs on the user end while keeping the environmental footprint of the device production and material use low by reusing existing functional components.

The secured end 12 of the piercing member may also be attached to base 3 via a hinge or a pivot point (not shown) which may allow the piercing member 5 to pivot in a controlled manner around the pivot point. This could be advantageous when it is desirable to release the mechanical stress on the needle 5 e.g. when the needle 5 arrives at a locked position or penetrates a relatively rigid surface which imposes additional mechanical stress on the piercing member 5 and thus may lead to uncontrolled irreversible deformations or damage to the needle 5 and the device 1. The piercing member 5 may be a hook or needle with a piercing tip to penetrate the surface of the respective materials where the piercing member 5 engages with.

Figure 4A:
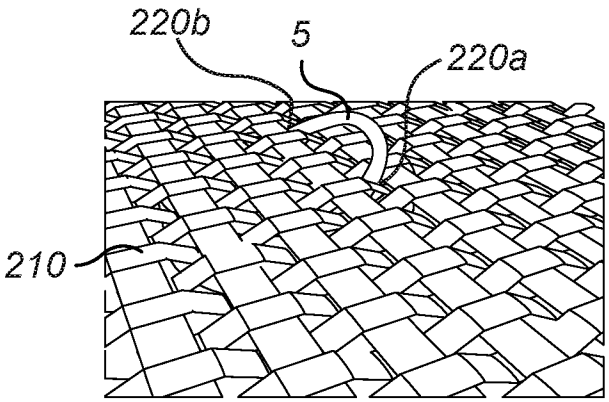
FIGS. 4*a*-4*b* show schematic and side views of the fastening device in use in accordance with one embodiment of the present invention.
Figure 4B:
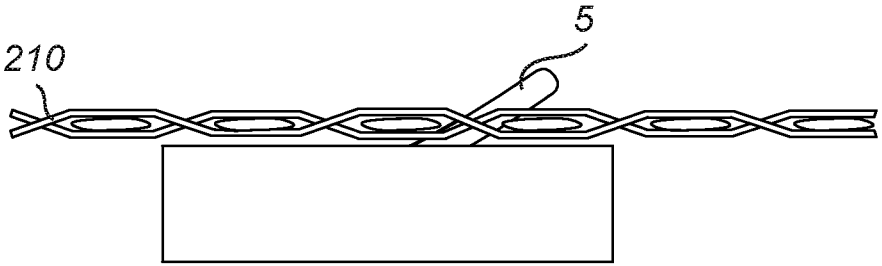

The needle 5 comprises a tip or piercing end 13 capable of penetrating and engaging with the target surface (see FIGS. 4*a*-4*b*).

Figure 1G:
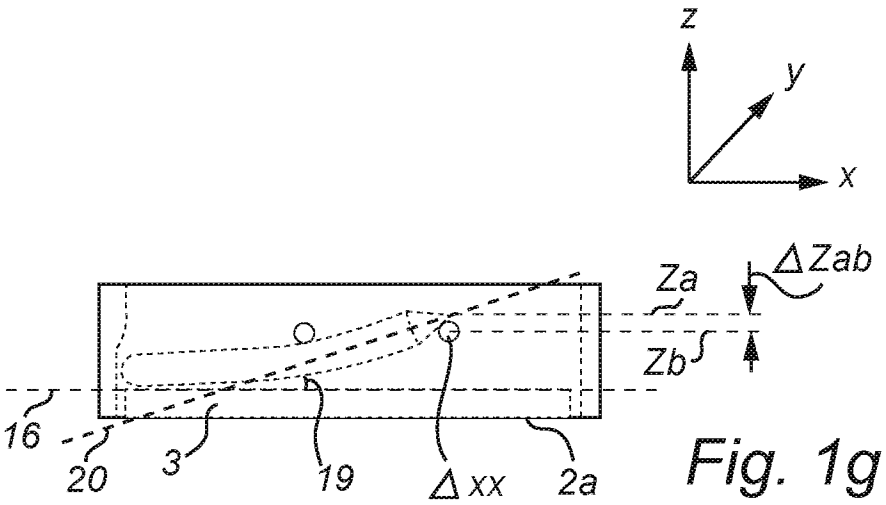
FIGS. 1*g*-1*i* show schematic side views of the fastening device of FIG. 1*b* in accordance with some embodiments of the present invention.
Figure 1H:
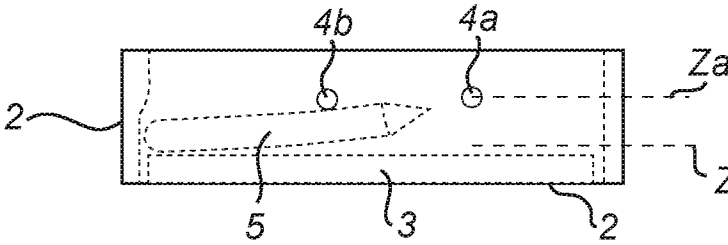
Figure 1I:
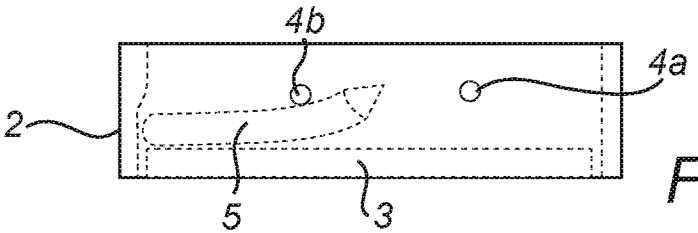
Figure 1B:
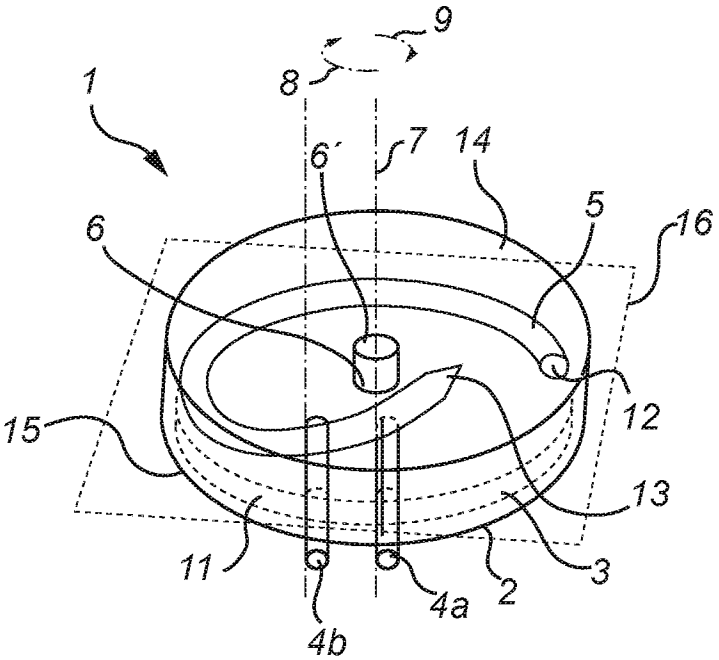

In a different embodiment, the fastening device 1 shown in FIG. 1*b* comprises a second abutment 4*b*. The second abutment 4*b* may be similar to the first abutment 4*a* in shape and geometry or may alternatively be of a different shape, size, orientation, etc. compared to the first abutment 4*a*. The piercing end 13 comes in contact with the first abutment 4*a* prior to the second abutment 4*b*. Stated differently, the second abutment 4*b* is spatially arranged before or behind the first abutment 4*a* in the x-direction or along a part of the path of the piercing member 5 (see FIGS. 1*g*-1*i*), and it is indeed the first abutment 4*a* which comes in contact with the piercing end 13 when the base 3 is rotated. Further, it should be noted that both the first and second abutments 4*a*, 4*b* may be a single protrusion points e.g. a bump, bar, rod, pin, etc. projecting out of or transverse to the reference plane 16 of the support frame 2 or projecting from a lateral side or a distal portion 10 of the support frame 2, at least partly contained or parallel to the plane 16 of the support frame 2.

In an example where the fastening device is used to attach external objects to a piece of garment of a user, the base 3 may have a height or thickness e.g. in the range of 1 mm to 20 mm.

The base 3 may have a diameter e.g. in the range of 1 mm to 200 mm. The assembled fastening device 1 may have a height or thickness e.g. in the range of 1 mm to 30 mm.

The assembled fastening device 1 may have a diameter e.g. in the range of 1 mm to 200 mm.

The piercing member 5 may have a thickness e.g. in the range of 0.05 mm to 5 mm or preferably in the range of 0.2 mm to 1.5 mm.

The piercing member 5 may have a diameter e.g. in the range of 1 mm to 200 mm.

It should however be appreciated that the above-mentioned components such as the base 3 of the piercing member 5 and the fastening device 1 may also have dimensions outside the aforementioned ranges and the skilled person may simply contemplate those dimensions based on the intended design and other applications of the fastening device 1.

Figure 7A:
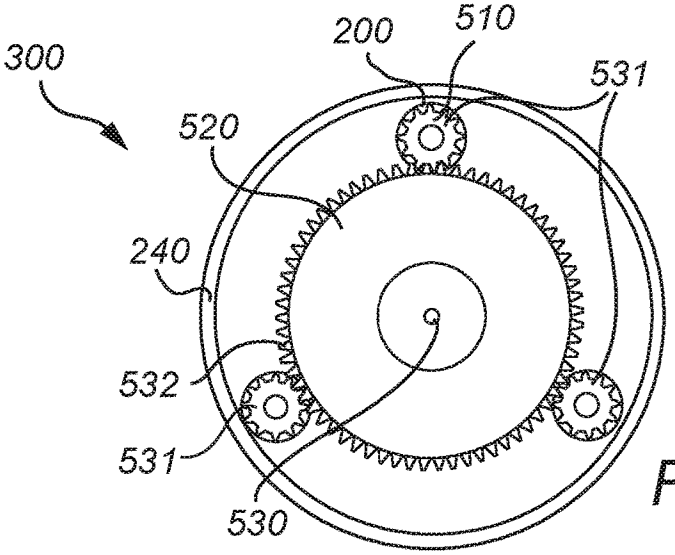
FIGS. 7*a*-7*d* show schematic views of the fastening device and a power transmission mechanism in accordance with some embodiments of the present invention.
Figure 7D:
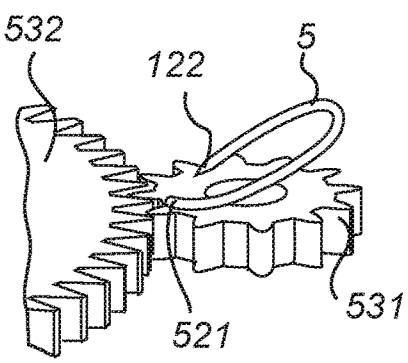
Figure 7C:
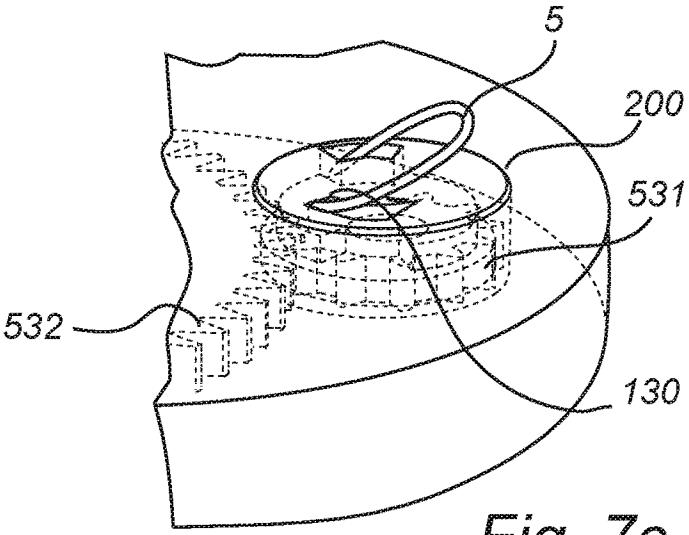

Returning back to FIG. 1*a*, the fastening device 1 has a coupling surface or coupling side 14 which can be arranged to interface with the target surface. In the context of present disclosure, "interface with" is to be construed as to become in physical contact, placed against, pushed on, fit onto or adjusted to the target surface such that in use the piercing member 5 of the fastening device 1 is enabled to penetrate and pierce the target surface upon rotational motion of the base 3. In other words, the coupling side 14 is the side of the fastening device 1 placed against and facing the target surface. The coupling side 14 may be e.g. a top side 14 of the fastening device 1 or it may be a bottom side 15 of the fastening device 1. By the "top" and "bottom" sides of the fastening device 1 it is meant that the top side 14 is a side that has a higher vertical elevation in the z direction than the bottom side 15. The top 14 and bottom side 15 of the fastening device 1 may also alternatively referred to as the top and bottom sides of the support frame 2. The bottom side 15 of the fastening device 1 may be used to couple the rotatable base 3 to a power transmission device (see FIG. 2*c* and FIG. 7*c*) arranged to rotate the base 3.

FIGS. 1*c*-1*f* illustrate side views of the fastening device 1 of FIG. 1*a* comprising the first abutment 4*a*. In FIG. 1*c*, the base 3 is in its initial position and thus the piercing member 5 is in retracted or resting position. In the resting position, a portion of the body of the piercing member 5 or e.g. the piercing end 13 may form an angle 17 with the reference plane 16 of the support frame 2. The piercing end 13 of the piercing member 5 has a vertical elevation (height) of e.g. zn1 in the resting position. the elevation height zn1 may for example be in the range of 0 to 30 mm with respect to the reference plane 16 of the support frame. The first abutment 4*a* may have a vertical elevation of za, which is for example in the range of 0 mm to 30 mm with respect to the reference plane 16. In the resting position the piercing end 13 may have an extension of for example x0 in the x direction. As shown in FIG. 1*d* when the base 3 is rotated the piercing end 13 of the piercing member 5 follows a first curved trajectory from the resting position x0 to arrive at the abutment 4*a* with e.g. a lateral extension of xa. The positions and extensions of the piercing end 13 may also be defined by the radial distance of the piercing end 13 from the central part of the base 6 e.g. r0 at x0 and ra at xa (not shown) with corresponding azimuthal angles e.g. ø0 at x0 and øa at xa (not shown). The first trajectory generally has a plane 18 which can be partly/substantially parallel to the reference plane 16. Upon the transition/movement of the piercing end 13 from x0 to xa and contact with the first abutment 4*a* the initial angle 17 of the piercing member 5 with the reference plane 16 increases. The angle between the piercing member 5 and the reference plane 16 when the piercing end 13 comes in contact with the first abutment 4*a* which may be referred to as contacting angle 19 increases compared to the initial angle 17 by at least 10 degrees or, at least 20 degrees, or at least 30 degrees, or at least 50 degrees or at least 80 degrees. Alternatively or additionally, the contacting angle 19 may increase by at most 10 degrees or, at most 20 degrees, or at most 30 degrees, or at most 50 degrees or at most 80 degrees.

The contacting angle 19 can also be defined as the angle of the plane 20 of a second trajectory of the piercing end 13 with the reference plane 16. It should be noted that when the piercing end 13 of the piercing member 5 comes in contact with the first abutment 4*a*, it follows a second trajectory which has plane 20 offset by a deviation angle from the plane 18 of the first trajectory. The deviation angle therefore can be defined as the difference between the contacting angle 19 and the initial angle 17 and when the initial angle 17 is substantially small to be neglected, the deviation angle may be approximately the same as the contacting angle 19.

As the base 3 continues to rotate, the contacting angle 19 may be kept constant or increase even further based on the resilience and the amount of deformation which the piercing member 5 would undergo. The piercing end 13 also undergoes a vertical elevation from the initial height zn1 to e.g. a second elevation, zn2 during the rotation of the base 3 e.g. after contacting the abutment 4*a*. For example, zn2 may be the height of the piercing end 13 when protruding out of the plane 21 of the coupling side 14 or a height peak of the piercing end 13 with respect to the reference plane 16. The amount of such elevation also depends on the angle of deviation of the first and second trajectories and the rigidity/resilience of the piercing member. After the piercing end 13 reaches the height peak, by further rotating the base 3, it descends in the vertical direction and by following its trajectory moves downwardly until it reaches a releasably locked position at the end of its final trajectory e.g. the second trajectory. This way an open ring-shaped or loop-shaped hook can be created which e.g. may extends from a first piercing point to a second piercing point on the target surface (see FIGS. 4*a*-4*b*).

FIG. 1*e* illustrates one embodiment where the first abutment is not necessarily fixed at a certain position with a specified height and rather is enabled to move between at least two different height elevations in the z direction. For instance, at the resting position of the piercing member 5, the first abutment 4*a* may be arranged at a height of za' and upon rotation of the base 3 or contact with the piercing end 13 move upwardly to a second height za.

The first abutment 4*a* may be moved manually or automatically by a dial, a lever, slide, gear, etc. that adjust the vertical height of the first abutment 4*a*.

In another embodiment shown in FIG. 1*f* the piercing end 13 of the piercing member 5 may be bent slightly upward such that the piercing end 13 is enabled to simply engage the abutment 4*a* and undergo the change of trajectory. This can for instance be advantageous to use with more rigid piercing members 5 wherein the piercing member 5 may require to securely engage with the abutment 4*a* prior to undergoing deformation and change of trajectory.

FIGS. 1*g*-1*i* illustrate side views of some embodiments of the fastening device 1 of FIG. 1*b* comprising the second abutment 4*b* in addition to the first abutment 4*a* in use. The present inventor has realized that by providing a second abutment 4*b* in the path of the piercing member 5*a* substantial control over the movement of the piercing member 5 can be achieved. After the trajectory of the piercing end 13 is changed by the first abutment 4*a*, it reaches a quasi-stationary positon where a portion 22 of the piercing member 5 comes in contact with the second abutment 4*b*. At this stage the piercing member 5 is kept under a controllable amount of mechanical stress due to the rotational force exerted by the rotating base 3 at one end i.e. the secured end 12 and the force exerted on the portion 23 positioned between the first 4*a* and second 4*b* abutments. The amount of mechanical stress may be controlled by amount of exerted force, or by varying vertical extensions, lateral or longitudinal extensions, and/or vertical or lateral distances between the abutments, etc. The second abutment 4*b* is arranged e.g. at a lateral extension xb. After reaching the first abutment 4*a* at xa and change of trajectory of the piercing end 13 and vertical elevation of the piercing member 5, the portion 22 of the piercing member 5 comes in contact with the second abutment 4*b*. In addition to keeping the piercing member 5 under controlled mechanical stress and ensuring the smooth movement of the piercing member 5 during the rotational movement of the base 3, the second abutment 4*b* is also configured to prevent the vertical elevation of the portion 22 of the piercing member 5 to exceed a certain height, for example height of zb where the second abutment 4*b* is arrange. In this embodiment the first abutment 4*a* is arranged at a higher vertical elevation than the second abutment 4*b* (za>zb). This is advantageous, since by tailoring the height difference, Δzab, between the first 4*a* and second 4*b* abutments the trajectory of the piercing end 13 and thus the deviation angle can be simply controlled. In other words, by increasing Δzab steeper or larger angles of deviation and accordingly sharper penetration angles to the target surface can be achieved. Additionally or alternatively, by changing and controlling the distance or lateral extension difference, Δxab, between the first 4*a* and second 4*b* abutments the deviation angle can also be modified. For instance, by decreasing the distance Δxab, steeper angles of deviation and thus steeper penetration angles to the target surface may be achieved. Combination of height and lateral distance variations may be used to customize the angle of deviation.

FIG. 1*h*, illustrates an embodiment where the first abutment 4*a* is allowed to move vertically between at least two height positions za' and za. This embodiment differs from the embodiment of FIG. 1*e* in that there is a second abutment 4*b* arranged in addition to the first abutment 4*a*.

FIG. 1*i*, illustrates an embodiment wherein the piercing end 13 of the piercing member 5 has been bent slightly upward to ensure a secured engagement of the piercing member 5 with the first abutment 4*a*. This embodiment differs from the embodiment of FIG. 1*f* in that there is a second abutment 4*b* is arranged in addition to the first abutment 4*a*. all advantages achieved in the embodiments of FIGS. 1*e* and 1*f* are also correspondingly achieved in embodiments of FIGS. 1*h* and 1*i* together with advantages provided by the second abutment 4*b*.

Figure 2A:
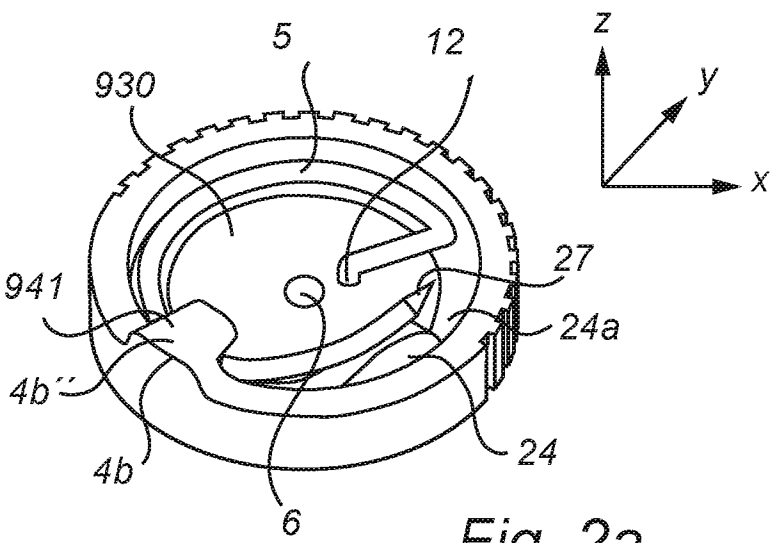
FIGS. 2*a*-2*b* show schematic perspective views of the fastening device in accordance with at least one other embodiment of the present invention.
Figure 2B:
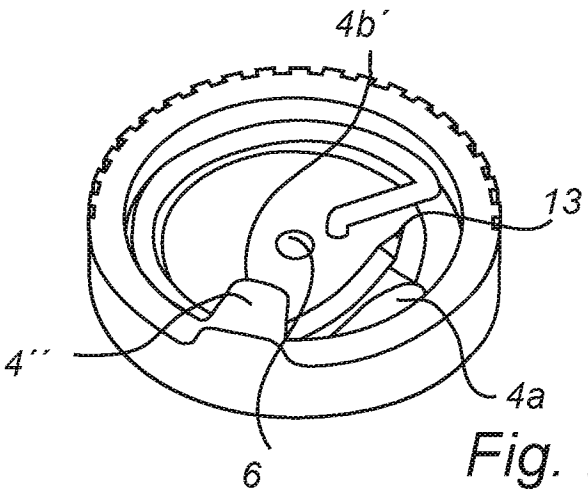

FIGS. 2*a* and 2*b* illustrate schematic perspective views of the fastening device 100 in yet another embodiment of the present invention wherein the support frame 2 may comprise two interconnected part. For example, an inner part 24*a* and an outer part 24*b* at least partly encompassing the inner part 24*a*. In case of a circular base 3 as shown in FIGS. 2*a*-2*b*, the rotatable base 3 may be enclosed by the inner part 24*a* of the support frame and thus the support frame 24*a*, 24*b* may also have a circular or ring-shaped geometry extending at least partly along the circumference of the rotatable base 3. The inner part 24*a* and outer part 24*b* of the support frame are enabled to rotate with respect to each other and with respect to the base 3. An advantage of this arrangement is that by arranging the first 4*a* and second 4*b* abutments on one of the inner part 24*a* or outer part 24*b* of the support frame 2 and by rotating the inner 24*a* and outer 24*b* parts with respect to each other the distance between the first 4*a* and second 4*b* abutments can be conveniently adjusted. for instance, the user of the fastening device 100 can adjust the distances during the operation of the device. This allows the user to achieve different deviation angles and accordingly different penetration angles to the target surface.

Figure 2C:
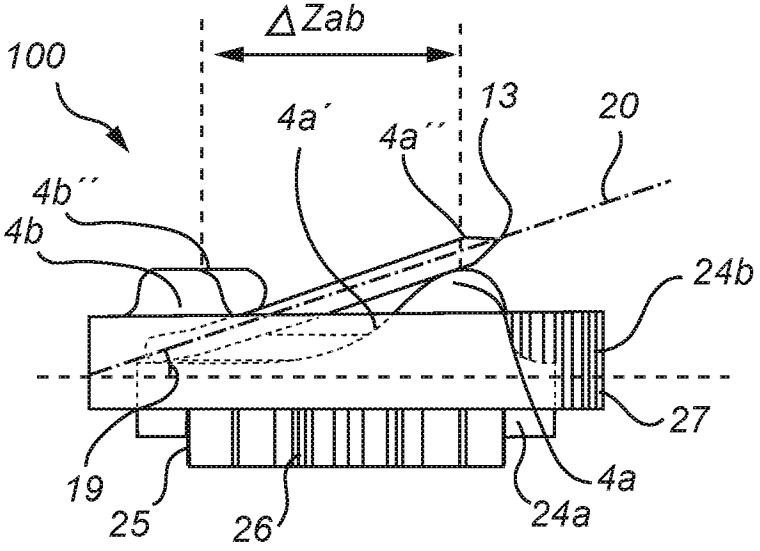
FIGS. 2*c*-2*d* show schematic side views of the fastening device in accordance with some embodiments of the present invention.
Figure 2D:
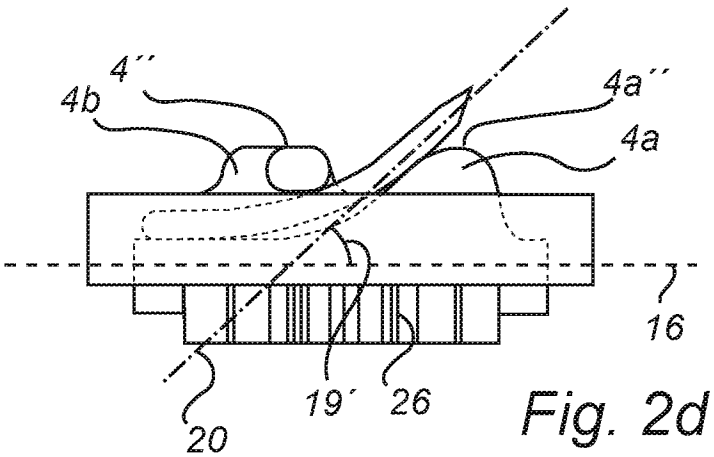
Figure 7B:
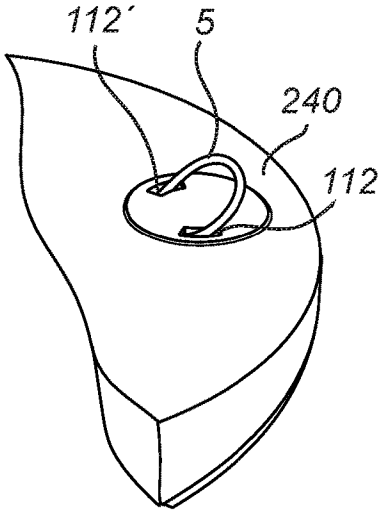

In this embodiment as shown in FIGS. 2*c* and 2*d* the first abutment 4*a* is arranged on the inner part 24*a* and the second abutment 4*b* is arranged on the outer part 24*b* of the support frame 2. The first abutment 4*a* has a rising sloped portion 4*a*' forming a bump-shaped projection 4*a*" at its uppermost altitude. The sloped portion 4*a*' can simply guide the piercing end 13 of the piercing member 5 towards the bump projection 4*a*" of the first abutment 4*a* which is arranged to change the trajectory of the piercing end 13. In a resting position, the piercing member 5 may also partly rest on the sloped portion 4*a*'. The second abutment 4*b* may have a bumped projection 4*b*" with a portion 4*b*' extending radially toward the central part 6 of the base 3. The central part 6 of the base 3 may be arranged to be connected to an external axel 6'. The base 3 may alternatively be arranged to rotate without the need for a central axel 6'. The inner part 24*a* of the support frame 2 may have an opening for the bottom part 25 of the base 3 to protrude and enabled to couple to a power transmission device (see FIG. 7*b*-7*d*). The bottom part 25 of the base 3 may comprise cogs or teeth 26 to be coupled to the power transmission device.

In FIG. 2*c* the first 4*a* and second 4*b* abutments are arranged at a distance of Δxab and the deviation angle 19 is determined by this distance. In this example the abutments 4*a*, 4*b* are arranged at the same height and the initial angle 17 is negligible. By rotating the inner 24*a* and outer 24*b* parts as shown in FIG. 2*d* the first 4*a* and second 4*b* abutments approach each other and thus the distance between the abutments 4*a*, 4*b* decreases to Δx'ab (Δx'ab<Δxab). This in turn causes the deviation angle 19' to increase and become sharper. The inner part 24*a* and outer part 24*b* may be coupled together by means of cogs or teeth or rotationally slide in relation to each other within respective grooves made on each part. The outer part 24*b* may also be provided with a plurality of teeth/cogs 27 facilitating the coupling of the outer part 24*b* of the support frame to a power transmission device (not shown) to drive and rotate the outer part 24*b*. As it should be appreciated the above-discussed inner and outer parts may all be moving parts or only some of the parts be moving parts, e.g. the inner part 24*a* may be a stationary component and only the outer part 24*b* rotate to adjust the distance between the first 4*a* and second 4*b* abutments or vice versa.

Figure 3F:
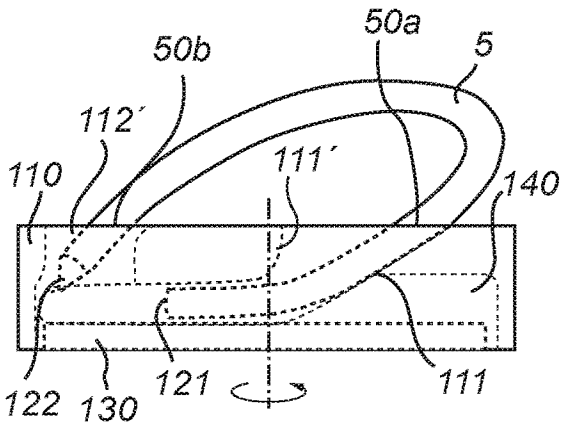
FIGS. 3*d*-3*f* show schematic side views of the fastening device in different rotated positions of the rotatable base in accordance with at least one embodiment of the present invention.
Figure 3E:
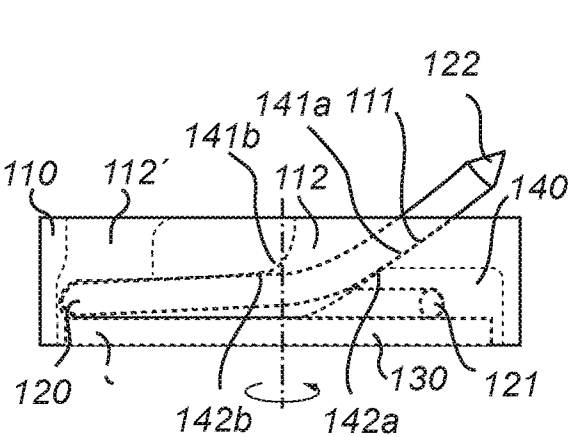
Figure 3D:
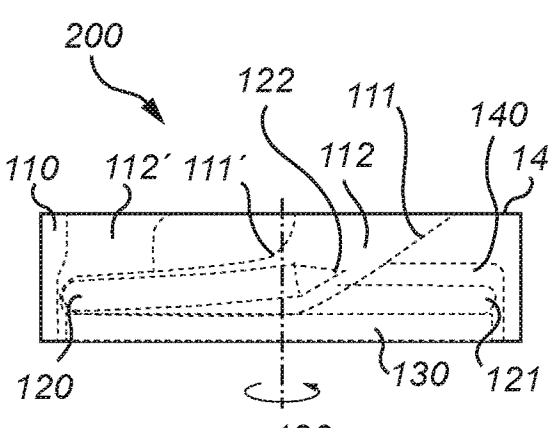
Figure 3C:
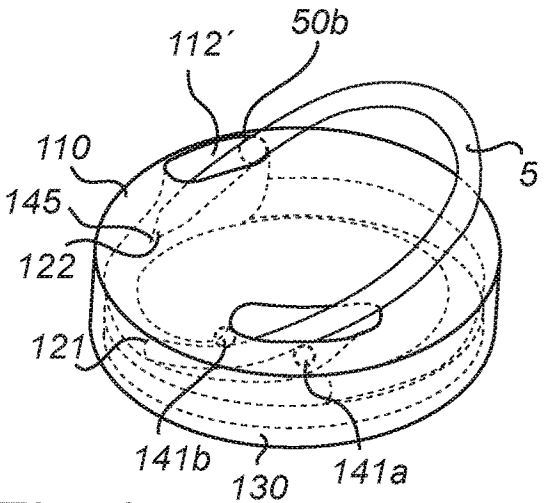
FIGS. 3*a*-3*c* show schematic perspective views of the fastening device in different rotated positions of a rotatable base of the fastening device in accordance with at least one other embodiment of the present invention.
Figure 3B:
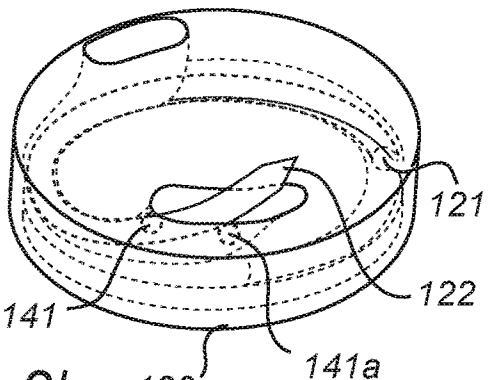
Figure 3A:
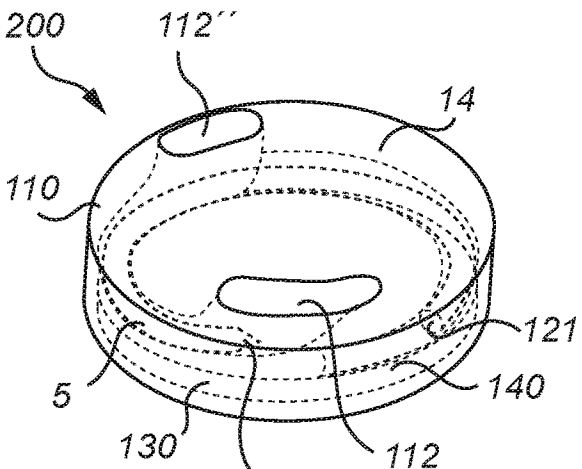

FIGS. 3*a*-3*f* illustrate another embodiment of the invention. FIGS. 3*a*-3*c* show perspective views of the fastening device 200 and FIGS. 3*d*-3*f* show corresponding side views of the fastening device 200 of FIGS. 3*a*-3*c*. In this embodiment the fastening device 200 comprises, a housing 110 alternatively referred to as a casing, or enclosure, which encompasses the piercing member 120, the rotating base 130, and the support frame 140. This embodiment differs from the previously described embodiments in that the support frame 140 is integrated as a part of the housing 110. It should however be readily understandable to the reader that the housing need not be provided with an integrated support frame 140 and alternatively the fastening device with a self-contained support frame as described earlier may be enclosed in a housing 110. The housing comprises portions e.g. sloped portions 111 and 111' which serve to facilitate the change of trajectory of the piercing member 120 during the rotational motion of the base 130. In this embodiment the first abutment 141*a* is provided by the sloped portion 111 and the second abutment 141*b* is provided by the sloped portion 111' of the integrated support frame 140 of the housing 110. This way advantage is taken from the geometry of the support frame 140 and the need to arrange protruding elements such as bumps, rods, pins, etc. is thus alleviated. As explained in the previous embodiments with two abutments, controlled mechanical stress is applied to the piercing member in this embodiment as well.

In the retracted position (FIGS. 3*a* and 3*d*), the piercing end 122 and generally the entire body of the piercing member 120 are sitting inside the housing 110. The piercing end 122 in this position is thus not being projected out of the plane 21 of the coupling side 14 of the fastening device 200. Optionally at least part of the body of the piercing member 120 e.g. the piercing end 122 may rest on the sloped portion 111 in the retracted position.

In the intermediate position (FIGS. 3*b* and 3*e*), as the rotating base 130 is rotated in the first direction 9, around its axis of rotation 7, and the piercing member 120 comes in contact with the abutments 141*a*, 141*b* the piercing end 122 of the piercing member 120 is pushed out of the first opening 112 arranged on the coupling side 14 of the housing 110.

As the rotating base 130 is rotated further in the first direction 9, the piercing end 122 reaches the height peak with a vertical elevation of zn3 with respect to the reference plane 16 of the support frame. The height peak zn3 may alternatively be defined as the vertical elevation of the body of the piercing member 5 with respect to the reference plane 16. In continuation of the second curved trajectory, the piercing end 122 is enabled to submerge into the second opening 112' and arrive at a releasably locked position wherein the piercing member 5 forms an open-ring shaped hook extending e.g. from the point of emergence 50*a* out of the first opening 112 to the point of submergence 50*b* into the second opening 112'.

FIGS. 4*a*-4*b* show schematic perspective and side views of the fastening device in accordance with some embodiments. FIG. 4*a* demonstrates the fastening device 200 engaged and locked to a sheet of material 210 e.g. cloth. (only the piercing member 5 extending from the first piercing point 220*a* to the second piercing point 220*b* forming a loop-shaped hook is visible in this view) FIG. 4*b* (side view) shows the fastening device 200 with the piercing member 5, penetrated the sheet of material 210 and the piercing end (not visible) sitting at the designated releasably locked position. Therefore, the fastening device 200 is remaining attached to the sheet of material 210 unless a retraction process (detachment of the fastening device by rotating the base in an opposite direction to the primary rotational direction used for the fastening function) is e.g. triggered by the user and thus the piercing member is caused to be retracted from the first 220*a* and second 220*b* piercing points.

The sheet of material may also be a grid or mesh of other material such as metal, wood, or organic materials such as plants or animal skin.

Figure 5A:
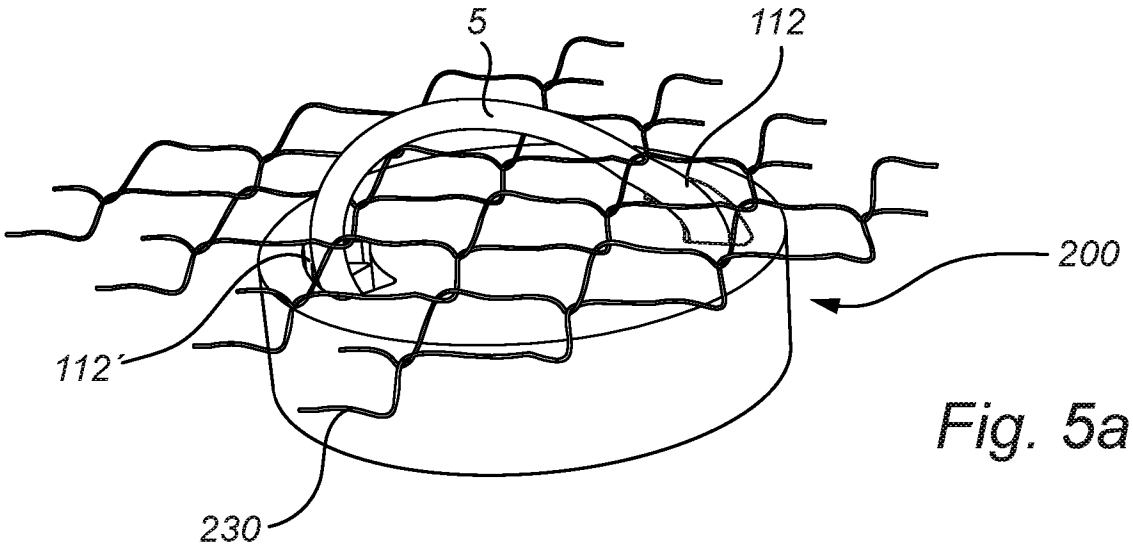
FIGS. 5*a*-5*b* show schematic and side views of the fastening device in use in accordance with another embodiment of the present invention.
Figure 5B:
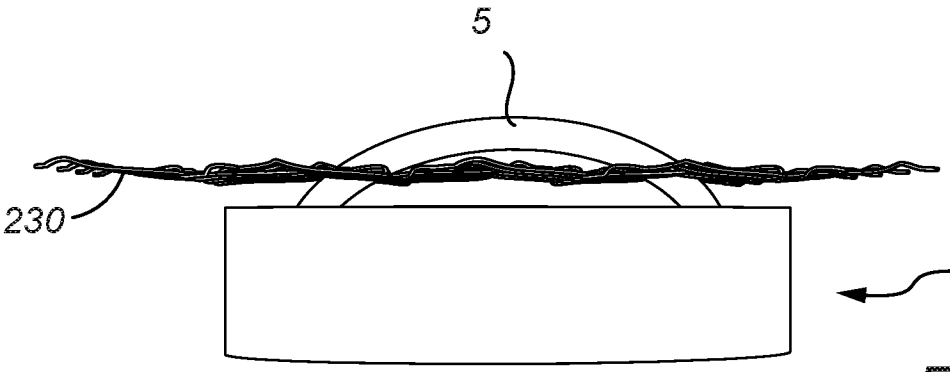

FIG. 5*a*-5*b* illustrate the fastening device 200 engaged and locked to a metallic fence 230 from the top perspective (FIG. 5*a*) and the side (FIG. 5*b*) view. In FIG. 5*a* the piercing member 5 is demonstrated to be protruded from the first designated opening 112 on the housing 110, engaged with the metallic fence 230, and submerged in the second designated opening 112'.

Figure 6B:
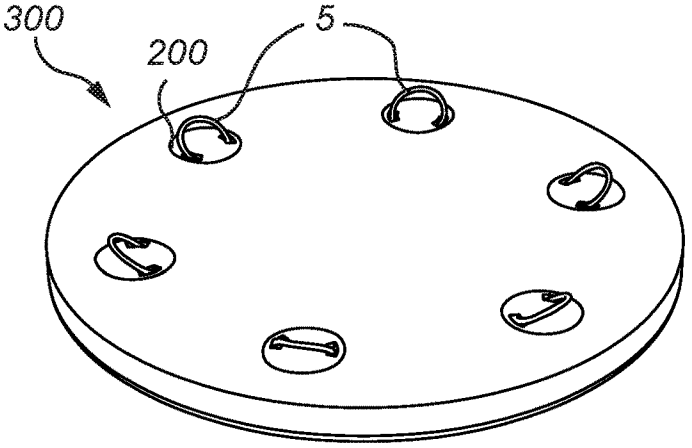
FIGS. 6*a*-6*c* show schematic perspective views of the fastening device in accordance with some embodiments of the present invention.
Figure 6A:
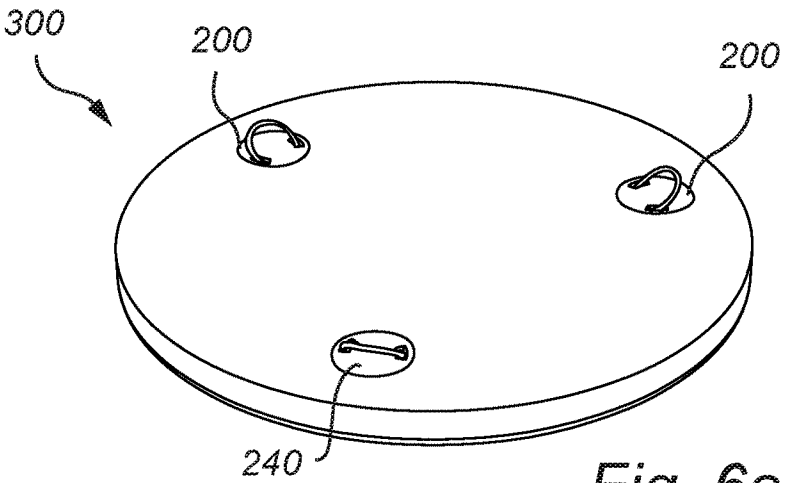
Figure 6C:
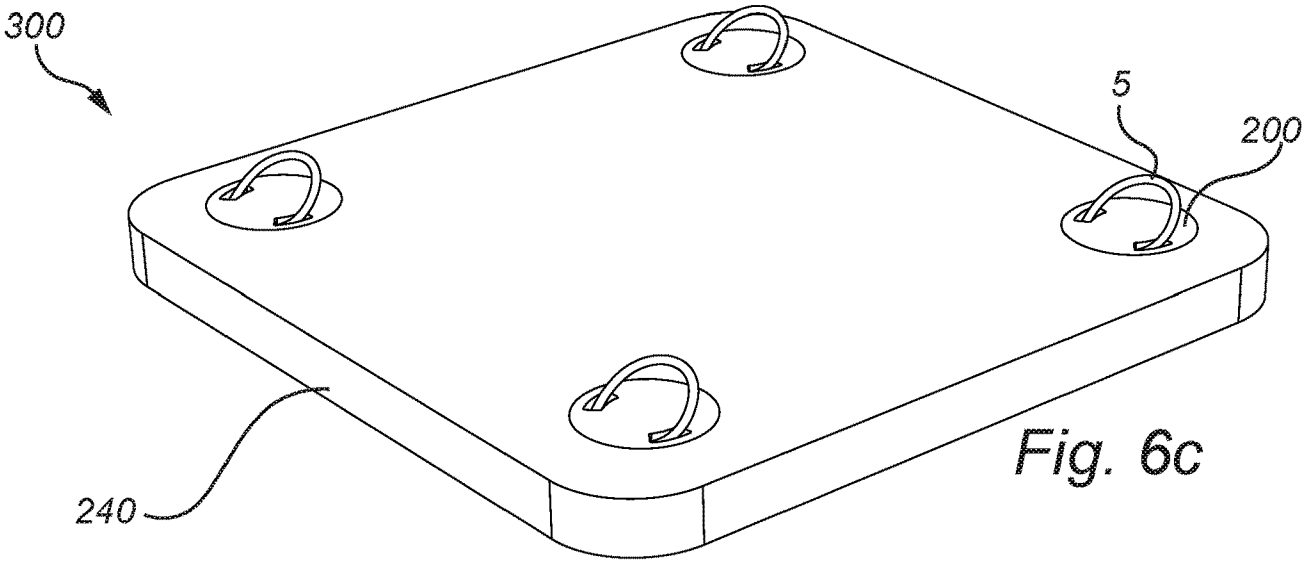

FIGS. 6*a*-6*c* demonstrate other embodiments of the present invention with the housing 110 arranged such that more than one individual fastening device 1, 100, 200 comprising at least the rotatable base 3, 130 and the piercing member 5 (in some embodiments the individual devices 1, 100, 200 may optionally comprise a self-contained support frame and/or a self-contained housing) can be installed in a common housing 240. Thus a scalable variety of the fastening device 300 with a plurality of individual fastening devices can be realized. Further, an advantage of producing modular devices can be achieved this way by providing fastening devices 300 with individual fastening devices (modules) which can be added to and/or removed from the common housing 240 of the scaled fastening device 300 by the user e.g. by a snap action, etc. The size and geometry of the common housing 240 may be modified to the size, geometry and number of individual fastening devices. For example, the scalable fastening device 300 (common housing 240) may have a shape of a disc (FIGS. 6*a* and 6*b*) or e.g. a square shape (FIG. 6*c*) comprising 2, or 3, or 4, or 6 or more individual fastening devices.

FIGS. 7*a*-7*d* schematically illustrate the coupling of a power transmission device 520 to the rotatable base 130. Top view (FIG. 7*a*) shows the inside of the common housing 240 and perspective views (FIG. 7*b*-7*d*) in this embodiment show that the fastening device 300 comprises three individual fastening devices 200 each provided with coupling teeth (cogs) 531 arranged on a cogwheel 510 as a part of the rotatable base 130. The three individual devices 200 are arranged in the common housing 240 and are configured to be coupled to the cogs 532 of a central cogwheel 520 operating as the power transmission device 520. The power transmission device 520 is also arranged in the common housing 240. In this embodiment the power transmission device 520 is connected to the actuator device (see FIG. 10*c*) at the central part 530 of the central cogwheel 520. Additionally or alternatively, the actuator device may be connected to at least one of the cogwheels 510 of the individual devices 200 and transfer the driving power to the other individual devices 200 via the central cogwheel 520.

Figure 8B:
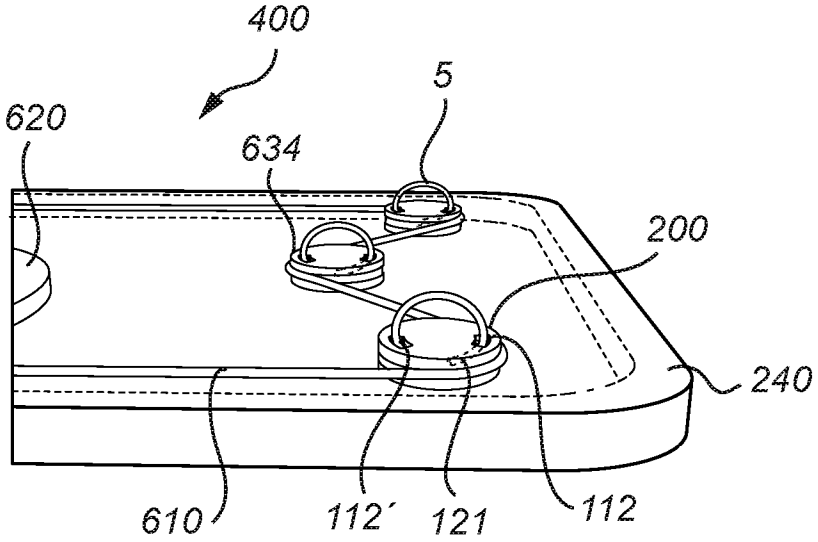
FIGS. 8*a*-8*b* show schematic perspective views of the fastening device and the power transmission mechanism in accordance with yet another embodiment of the present invention.
Figure 8A:
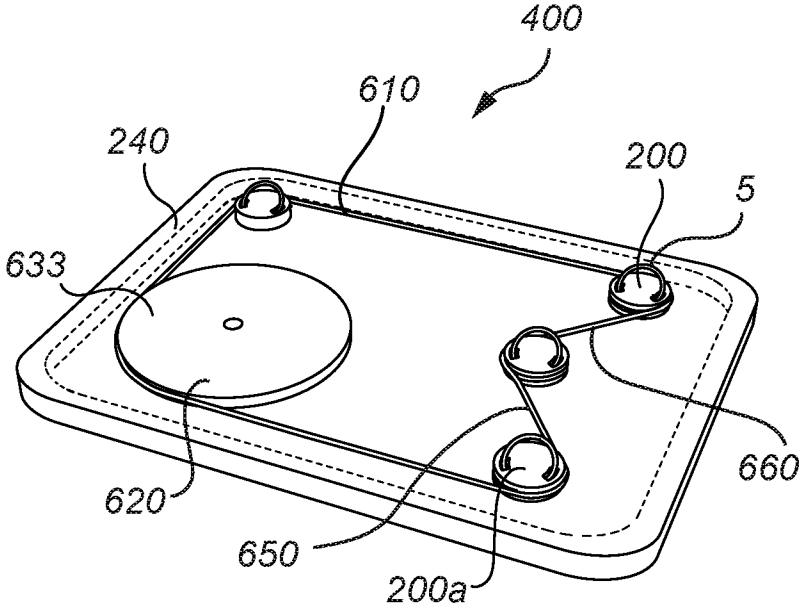

FIGS. 8*a*-8*b* illustrate another embodiment of the present invention from a perspective (FIG. 8*a*), and a zoomed-in perspective (FIG. 8*b*) view of the fastening device 400. In this embodiment the rotation of the rotating base is transferred to the piercing members 5 through a wire 610/cam 620 or timing belt mechanism imparting a reciprocal and/or variable (different direction, speed, rpm, etc.) rotational motion of the main cam 620 via the sliding contact with the wire 610 to the individual devices 200. FIG. 8*a* shows the fastening device 400 with four individual devices 200 encompassed within the common housing 240. In this embodiment the devices 200 include a self-contained housing 110 with the first 112 and second 112' openings. The housing 110 has been slightly modified such that the wire 610 is coupled to the rotating base 130 via a groove 630 extending at least partly around the circumference of the housing 110 and at least partly around the circumference of the rotating base 130. The housing 110 may be provided with an opening (not shown) at on its periphery which provides access to the groove 630 on the periphery of the rotating base to couple to the wire 610.

In other variations where there is no housing 110 present, the groove 630 may be arranged merely on the circumference of the rotating base. The common housing 240 may also be provided with openings (not shown) corresponding to the position of the piercing member 5 of the individual devices for facilitating the emergence and submergence of the piercing member 5. When the main cam 620, connected to the actuator device, is rotated, the rotational movement is transferred to each of the individual devices 200 via the wire 610. The individual devices can be arranged and coupled to the wire/cam arrangement in a customizable manner allowing to rotate them in either clockwise or counter clockwise directions depending on which side of the wire e.g. inner side 650 or outer side 660 of the wire they are arranged. For instance, in FIG. 8*a*, when the main cam 620 undergoes a clockwise rotation, device 200*a* rotates in the clockwise direction but device 200*b* rotates in the counter clockwise direction. Notwithstanding the above mentioned examples other variations in the size, number, rotational direction, of the individual devices with respect to the size, geometry or rotational direction of the wire/cam mechanism is readily conceivable to the skilled person. Further, similar to the embodiment of FIGS. 7*a*-7*d*, any one of the individual devices 200 may optionally be coupled to an actuator device instead of the main cam 620.

Figure 9A:
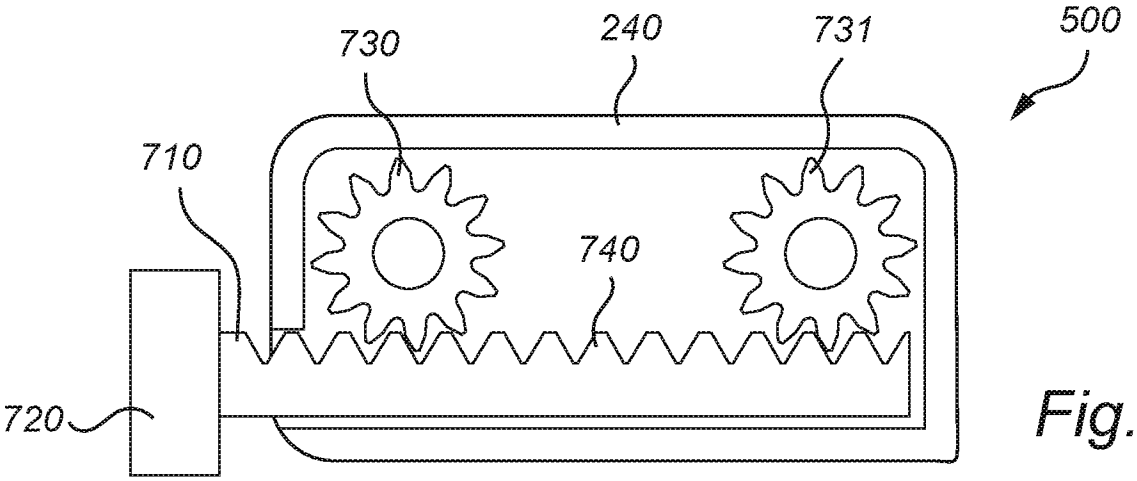
FIGS. 9*a*-9*b* show schematic bottom and top views of the fastening device and the power transmission mechanism in accordance with a further embodiment of the present invention.
Figure 9B:
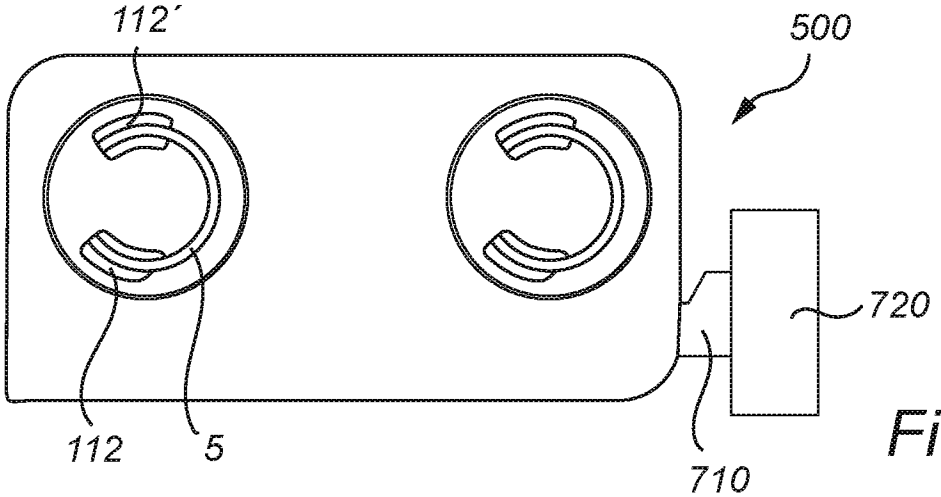

FIGS. 9*a*-9*b* show another embodiment of the present invention. In the fastening device 500 of this embodiment, rotation of the rotating base (not shown) is achieved by a transitional movement of a cogged rack 710. The teeth 740 on the rack 710 engage with the cut or inserted teeth 731 of the cogwheels 730 coupled to the rotating bases. Through this mechanism, the cogwheels 730 rotate, leading to the rotation of the bases and accordingly the movement of the piercing members. A lever 720 is used to move the straight rack 710 back and forth. If combined with a spring at the end of the rack 710, this embodiment may enable a faster functioning device for attaching/detaching items.

Figure 10C:
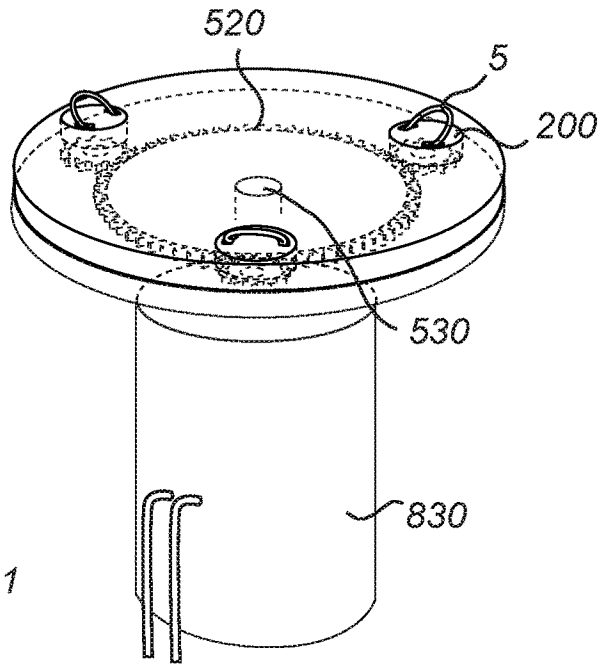
FIGS. 10*a*-10*c* show schematic views of the actuation mechanism in accordance with some embodiments of the present invention.
Figure 10B:
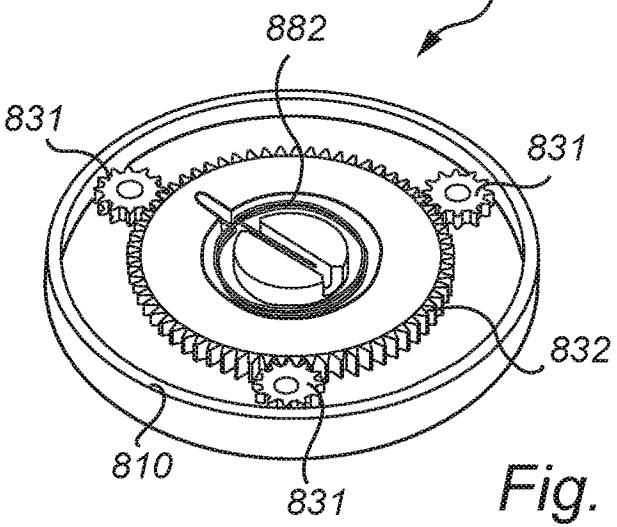
Figure 10A:
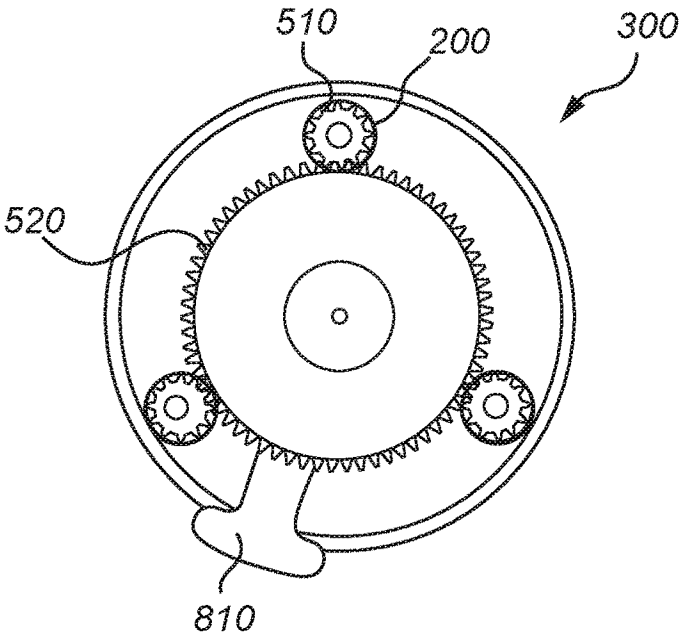

FIGS. 10*a*-10*c* demonstrate various power sources or actuator devices for providing the rotational movement to rotatable base according to the above-described embodiments of the inventive concept. Three different actuator devices illustrated here are exemplified for the embodiment of FIGS. 7*a*-7*d* with a central cogwheel 520 however similar actuator devices can be readily coupled to the fastening devices of the other embodiments of the invention. In FIG. 10*a* the fastening device 300 is driven by a lever 810. The lever 810 can e.g. be rotated manually or automatically, rotating the central cogwheel 520. As the central cogwheel 520 is rotated, the rotary movement is transferred to the smaller cogwheels 510 of the individual fastening devices 200.

FIG. 10*b* demonstrates an example wherein the actuator device is a tension spring 820 utilized for driving the central cogwheel 520 and correspondingly the individual cogwheels 510 of the individual devices 200.

In a different example shown in FIG. 10*c* an electric stepper motor 830 is coupled to the central part 530 of the central cogwheel 520 to provide the rotational motion to the individual fastening devices 200.

The invention has now been described with reference to specific embodiments. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements. Further, other components of the fastening device such as the rotatable base, the piercing member, the support frame, or the housing may for example be of any other size, curvature or orientation than the ones shown and explained according to the accompanying figures.

The invention claimed is:

1. A fastening device for removably attaching an object to a surface of a material, said fastening device comprising:

a base, rotatable in at least one direction around an axis of rotation;

a support frame arranged to mechanically support said base, wherein said base is configured to rotate with respect to said support frame and the axis of rotation of said base is transverse to a reference plane of said support frame;

at least one open-ring shaped piercing member comprising a secured end and a piercing end, said secured end attached to the base, and said piercing member configured such that the piercing end of said piercing member follows a first curved trajectory when said base is rotated; and a first abutment, arranged on said support frame and configured to, when brought in contact with said piercing member, cause said piercing end of the piercing member to follow a second curved trajectory, such that a plane of said second trajectory is offset by a deviation angle from a plane of said first trajectory.

2. The fastening device according to claim 1, wherein when said base is rotated from an initial position to a first piercing position, the piercing end of said piercing member is caused to pierce and engage with said surface at a first piercing point;

and wherein when said base is rotated to a final rotated position said piercing member is configured to reach a releasably locked position at the end of said second trajectory.

3. The fastening device according to claim 2, wherein, when said base is further rotated from said first piercing position to a second piercing position, the piercing end of said piercing member is further caused to pierce and engage with said surface at a second piercing point before it has reached said releasably locked position.

4. The fastening device according to claim 2, wherein, when said base is rotated from said first piercing position to the initial position, said piercing end of the piercing member is retracted and disengaged from said first piercing point on said surface.

5. The fastening device according to claim 2, wherein said fastening device further comprises:

a housing comprising said support frame, and said abutment, and encasing said base and said piercing member, said housing having a coupling side arranged to interface with said surface, said coupling side comprising a first opening disposed thereon such that when said base is rotated from said initial position to a first rotated position, the free piercing end of the piercing member is caused to protrude out of said first opening, and when said base is rotated from said first rotated position to a second rotated position the free piercing end of the piercing member is caused to reach a height peak with reference to the reference plane of said support frame and when said base is further rotated from the second rotated position to a third rotated position, the free piercing end of the piercing member is enabled to enter into a second opening arranged on said coupling side and disposed at a distance from said first opening, wherein said piercing member is configured to reach said releasably locked position when the free piercing end of the piercing member is inserted into said second opening.

6. The fastening device according to claim 5, wherein said deviation angle is determined by a vertical extension of said first abutment in relation to said reference plane of the support frame.

7. The fastening device according to claim 2, wherein said deviation angle is determined by a vertical extension of said first abutment in relation to said reference plane of the support frame.

8. The fastening device according to claim 1, wherein said fastening device further comprises:

a second abutment, arranged on said support frame and when in contact with said piercing member is configured for keeping said piercing member under a mechanical stress such that a portion of said piercing member which is in contact with the second abutment is prevented from a translational movement in the vertical direction with respect to said reference plane of the support frame.

9. The fastening device according to claim 8, wherein said deviation angle is determined by a distance between the first and the second abutments.

10. The fastening device according to claim 8, wherein said fastening device further comprises:

a housing comprising said support frame, and said abutment, and encasing said base and said piercing member, said housing having a coupling side arranged to interface with said surface, said coupling side comprising a first opening disposed thereon such that when said base is rotated from said initial position to a first rotated position, the free piercing end of the piercing member is caused to protrude out of said first opening, and when said base is rotated from said first rotated position to a second rotated position the free piercing end of the piercing member is caused to reach a height peak with reference to the reference plane of said support frame and when said base is further rotated from the second rotated position to a third rotated position, the free piercing end of the piercing member is enabled to enter into a second opening arranged on said coupling side and disposed at a distance from said first opening, wherein said piercing member is configured to reach said releasably locked position when the free piercing end of the piercing member is inserted into said second opening.

11. The fastening device according to claim 8, wherein said deviation angle is determined by a vertical extension of said first abutment in relation to said reference plane of the support frame.

12. The fastening device according to claim 1, wherein said fastening device further comprises:

a housing comprising said support frame, and said abutment, and encasing said base and said piercing member, said housing having a coupling side arranged to interface with said surface, said coupling side comprising a first opening disposed thereon such that when said base is rotated from said initial position to a first rotated position, the free piercing end of the piercing member is caused to protrude out of said first opening, and when said base is rotated from said first rotated position to a second rotated position the free piercing end of the piercing member is caused to reach a height peak with reference to the reference plane of said support frame and when said base is further rotated from the second rotated position to a third rotated position, the free piercing end of the piercing member is enabled to enter into a second opening arranged on said coupling side and disposed at a distance from said first opening, wherein said piercing member is configured to reach said releasably locked position when the free piercing end of the piercing member is inserted into said second opening.

13. The fastening device according to claim 12, wherein said deviation angle is determined by a vertical extension of said first abutment in relation to said reference plane of the support frame.

14. The fastening device according to claim 1, wherein said deviation angle is determined by a vertical extension of said first abutment in relation to said reference plane of the support frame.

15. The fastening device according to claim 1, wherein said open-ring shaped piercing member has a circular shape with an open portion.

16. The fastening device according to claim 1, wherein said device further comprises:

a power transmission device in mechanical connection with said base and connectable to an actuator device, said power transmission device configured to rotate said base by transmitting power from said actuator device to said base.

17. The fastening device according to claim 16, wherein said power transmission device comprises at least one of a rotating plate, a drive gear, a cogged rack, a belt drive, a chain drive, and a wire and cam.

18. The fastening device according to claim 16, wherein said actuator device comprises at least one of a lever, a tension spring, an electric servo motor, a stepper motor, a drill machine, and a petrol engine.

19. A method of removably attaching an object to a surface of a material, said method comprising:

providing a base, rotatable in at least one direction around an axis of rotation;

providing a support frame to mechanically support said rotatable base wherein the axis of rotation of said base is transverse to a reference plane of said support frame;

providing at least one open-ring shaped piercing member comprising a secured end and a piercing end, said secured end attached to said base and said piercing member configured such that the piercing end of said piercing member follows a first curved trajectory when said base is rotated; and providing a first abutment, arranged on said support frame and configured to, when brought in contact with said piercing member, causing said piercing end of the piercing member to follow a second curved trajectory, such that a plane of said second trajectory is offset by a deviation angle from a plane of said first trajectory.

20. The method according to claim 19, further comprising: when said base is rotated from an initial position to a first rotated position, causing the piercing end of said piercing member to pierce and engage with said surface at a first piercing point; and when said base is rotated to a final rotated position, causing said piercing member to reach a releasably locked position at the end of said second trajectory.

* * * * *